US006931812B1

(12) United States Patent
Lipscomb

(10) Patent No.: US 6,931,812 B1
(45) Date of Patent: Aug. 23, 2005

(54) WEB STRUCTURE AND METHOD FOR MAKING THE SAME

(76) Inventor: Stephen Leon Lipscomb, 8809 Robert E. Lee Dr., Spotsylvania, VA (US) 22553

( * ) Notice: Subject to any disclaimer, the term of this patent is extended or adjusted under 35 U.S.C. 154(b) by 529 days.

(21) Appl. No.: 10/022,871

(22) Filed: Dec. 20, 2001

Related U.S. Application Data

(60) Provisional application No. 60/257,094, filed on Dec. 22, 2000.

(51) Int. Cl.[7] ..... B32B 3/00

(52) U.S. Cl. ..... 52/653.1; 52/648.1; 52/DIG. 10

(58) Field of Search ..... 52/653.1, 648.1, 52/DIG. 10, 650.1, 651.07, 651.09, 638, 637; 428/98

(56) References Cited

U.S. PATENT DOCUMENTS

| | | | |
|---|---|---|---|
| 780,043 | A | 1/1905 | Korff |
| 809,293 | A | 1/1906 | Friedenthal |
| 889,395 | A | 6/1908 | Noyes |
| 1,200,487 | A | 10/1916 | Grimm |
| 1,444,491 | A | 2/1923 | Baldwin |
| 1,555,447 | A | 9/1925 | Bernstein |
| 1,733,779 | A | 10/1929 | Connell |
| 2,178,667 | A | 11/1939 | Littlefield |
| 2,682,235 | A | 6/1954 | Fuller |
| 2,709,975 | A | 6/1955 | Parker |
| 2,835,112 | A | 5/1958 | Monnet |
| 2,970,388 | A | 2/1961 | Yonkers |
| 2,986,241 | A | 5/1961 | Fuller |
| 3,063,519 | A | 11/1962 | Richter |
| 3,105,969 | A | 10/1963 | Banche et al. |
| 3,114,176 | A | 12/1963 | Miller |
| 3,129,531 | A | 4/1964 | Connor |
| 3,139,957 | A | 7/1964 | Fuller |
| 3,164,111 | A | 1/1965 | Lanni |
| 3,220,152 | A | 11/1965 | Sturm |
| 3,277,479 | A | 10/1966 | Struble, Jr. |
| 3,277,614 | A | 10/1966 | Marie |
| 3,292,317 | A | 12/1966 | Barrett |
| 3,305,997 | A | 2/1967 | Keay et al. |
| 3,365,790 | A | 1/1968 | Brauer |
| 3,407,560 | A | 10/1968 | Baumann |
| 3,421,280 | A | 1/1969 | Attwood et al. |
| 3,468,503 | A | 9/1969 | Snibbe |
| 3,494,578 | A | 2/1970 | Cureton |
| D218,765 | S | 9/1970 | Dattner |
| 3,563,374 | A | 2/1971 | Lund et al. |
| 3,565,442 | A | 2/1971 | Klein |
| 3,660,952 | A | 5/1972 | Wilson |

(Continued)

FOREIGN PATENT DOCUMENTS

| | | |
|---|---|---|
| BR | 1244842 | 9/1971 |
| CA | 742407 | 12/1966 |
| CA | 1101626 | 5/1981 |
| DE | 314458 | 9/1919 |
| FR | 1280634 | 12/1961 |
| GB | 17215 | 7/1910 |
| SU | 842156 | 6/1979 |

OTHER PUBLICATIONS

Borrego, J. *Space Structures*, Library of Congress Card # 67–2734, pp. 80–81 (Dec. 1968).

(Continued)

*Primary Examiner*—Alexander S. Thomas
(74) *Attorney, Agent, or Firm*—Dinesh Agarwal, P.C.

(57) ABSTRACT

A web structure includes a generally hexahedron-shaped frame having a plurality of points or vertices oriented in a manner that no more than three points lie in a common plane. Each pair of the points is connected by a line or frame segment and a plane includes three of the points. One line or frame segment passes through the plane and has first and second ends that are generally equidistant from the plane.

27 Claims, 38 Drawing Sheets

(5 of 38 Drawing Sheet(s) Filed in Color)

U.S. PATENT DOCUMENTS

| | | | |
|---|---|---|---|
| 3,665,882 | A | 5/1972 | Georgiev et al. |
| 3,668,876 | A | 6/1972 | Koehler |
| D224,522 | S | 8/1972 | Amie |
| 3,877,096 | A | 4/1975 | Scesney |
| 3,937,426 | A | 2/1976 | Pearce |
| 3,942,291 | A | 3/1976 | Hirata et al. |
| 3,953,948 | A | 5/1976 | Hogan |
| 3,968,808 | A | 7/1976 | Zeigler |
| 3,974,600 | A | 8/1976 | Pearce |
| 3,974,611 | A | 8/1976 | Satterthwaite |
| 4,004,429 | A | 1/1977 | Mouton, Jr. |
| 4,012,872 | A | 3/1977 | Stolpin |
| 4,074,497 | A | 2/1978 | Ono |
| 4,092,810 | A | 6/1978 | Sumner |
| 4,096,479 | A | 6/1978 | Van Buskirk |
| 4,133,538 | A | 1/1979 | Ambrose |
| 4,145,765 | A | 3/1979 | Malone |
| 4,146,997 | A | 4/1979 | Diethorn |
| 4,207,715 | A | 6/1980 | Kitrick |
| 4,219,958 | A | 9/1980 | Shulyak |
| 4,241,550 | A | 12/1980 | Sumner |
| 4,284,679 | A | 8/1981 | Blad et al. |
| 4,309,852 | A | 1/1982 | Stolpin |
| 4,330,969 | A | 5/1982 | Quaney |
| 4,333,446 | A | 6/1982 | Smyth |
| 4,448,832 | A | 5/1984 | Kidwell |
| 4,496,155 | A | 1/1985 | Goldfarb |
| 4,603,519 | A | 8/1986 | Lew et al. |
| 4,611,441 | A | 9/1986 | Wickens |
| 4,645,379 | A | 2/1987 | Grimsley et al. |
| 4,655,022 | A | 4/1987 | Natori |
| 4,719,726 | A | 1/1988 | Bergman |
| 4,729,197 | A | 3/1988 | Miller |
| 4,750,807 | A | 6/1988 | Chamayou dit Felix |
| 4,778,184 | A | 10/1988 | Fleischer |
| 4,833,843 | A | 5/1989 | Richter |
| 4,896,656 | A | 1/1990 | Johnson |
| 5,097,645 | A | 3/1992 | Sanderson |
| 5,146,719 | A | 9/1992 | Saito et al. |
| 5,184,789 | A | 2/1993 | Aldrin |
| 5,201,160 | A | 4/1993 | Sanchez |
| 5,580,013 | A | 12/1996 | Velke |
| 5,704,169 | A | 1/1998 | Richter |
| 5,765,326 | A | 6/1998 | Schuster |
| 5,904,006 | A | 5/1999 | Evans |

OTHER PUBLICATIONS

Morgan, George W. *Polyhedral Underwater Structures*, Offshore Technology Conference, OTC 1057. May 1969.
*Molecular Sieve*, Oil & Gas Journal, Mar. 27, 1972.
*Disaster Home*, Washington Post. P. C4, Jan. 11, 1977.
*Space & Ground Erectable Antenna Applications*, General Dynamics Convair Aerospace Division. Jun. 1971.
*Doomebook II*, 1971, p. 109.
H.S. M. Cexeter and Others On, *Uniform Polyhedra*, Philosophical Transactions of the Royal Society of London 1954, Series A, vol. 246, pp. 440–444 and 448–450 (1953–1954).
Pearce, P. *Structure in Nature Is a Strategy for Design*. 1978.
Geoderic Geometry, Dome Book 2, 1971.
*Load & Resistance Factor Design* (*LRFD*), American Institute of Steel Construction (AISC) Manual of Steel Construction (Second Edition) vol. 1, 1998 (4 pages).
Abraham J. Rokach, *Structural Steel Design*, Schaum's Outlines, McGraw–Hill 1991, Ch 4, pp. 23 and 28 (4 pages).
J. Perry and S. Lipscomb, *The generalization of Sierpinski's Triangle that lives in 4–space*, Accepted for publication (Dec. 2001) in Houston Journal of Mathematics, pp. 1–14.
M. Barnsley, *Fractals Everywhere*, Academic Press, Inc., Boston, Massachusetts, 1988, pp. 6–13, 43, 67, 172–186, 200–203 (31 pages).
J. Dugundji, *Topology*, Ally and Bacon, Boston, Massachusetts, 1966 pp. 418–419, 171–173 (7 pages).
R. Engelking, *Dimension Theory*, North–Holland Math. Library vol. 8, North–Holland, New York, 1978 pp. 274–275, 297 (5 pages).
W. Hurewicz and H. Wallman, *Dimension Theory*, Princeton University Press, Princeton, New Jersey, 1948, p. 64(2 pages).
J. L. Kelley, *General Topology*, Van Nostrand, Princeton, N.J., 1955 p. 125 (3 pages).
H. J. Kowalsky, *Einbettung Metrischea Räume*, Arch. Math., vol. 8, 1957, pp. 336–339. MR 19 # 971.
E. J. Kummer, *Über Ergänzungssätze zu den allgemeinen Reziprozitätsgesetzen*, J. reine angew. Math., vol. 44, 1852, pp. 93–146.
S. L. Lipscomb, *A Universal One–dimensional Metric Space*, Lecture Notes in Mathematics vol. 378—TOPO 72 General Topology and Its Applications, Springer Verlag, 1974, pp. 248–257.
S. L. Lipscomb, *On Imbedding Finite–dimensional Metric Spaces*, Transaction of the American Mathematical Society, vol. 211, 1975, pp. 143–160.
S. L. Lipscomb, *An Imbedding Theorem for Metric Spaces*, Proceedings of the American Mathematical Society, vol. 55, 1976, pp. 165–169.
S. L. Lipscomb and J. C. Perry, *Lopscomb's L(A) space fractalized in Hilbert's $I^2$ (A) space*, Proceedings of the American Mathematical Society, vol. 115, 1992, pp. 1157–1165. MR 92j:54051.
B. B. Mandelbrot, *The Fractal Geometry of Nature (Rev. ed. of) Fractals*, c1977, W. H. Freeman and Company, New York, plates 141, 143, 1983 (4 pages).
K. Morita and S. Hanai, *Closed Mappings and Metric Spaces*, Proc. Japan Acad., vol. 32, 1956, pp. 10–14.
J. R. Munkres, *Elements of Algebraic Topology*, Benjamin/Cummings, Reading, Massachusetts, 1984, pp. 2–6 (7 pages).
U. Milutinović, *Completeness of the Lipscomb Universal spaces*, Glasnik Matematićki, vol. 27 (47), 1992, pp. 343–364. Mr 94h:54044.
J. Nagata, *Modern Dimension Theory*, Sigma Series in Pure Mathematics, vol. 2, Helderman Verlag, Berlin, 1983, pp. 8–9, 157 (5 pages).
J. Nagata, *A Survey of Dimension Theory III*, Proceedings of the Steklov Institute of Mathematics, Issue 4, 1941 (AMS publication 1984), pp. 201–213.
J. Nagata, *A Remark on General Imbedding Theorems in Dimension Theory*, Proc. Japan Acad., vol. 39, 1963, pp. 197–199. MR 29 # 1616.
G. Nöbeling, *Über eine n–dimensionale Universalmenge im $R_{2n+1}$*, Math. Ann., vol. 104, 1931, pp. 71–80.
H. Peitgen, J. Jürgens, and D. Saupe, *Chaos and Fractals* (*New Frontiers of Science*), Springer–Verlag New York, Inc., New York, 1992 pp. 132–133 (4 pages).
J. C. Perry, *Lipscomb's Universal Space is the Attractor of an Infinite Iterated Function System*, Proceedings of the American Mathematical Society, vol. 124, 1996, pp. 2479–2489.
W. Rudin, *Real and Complex Analysis*, McGraw–Hill, Inc., New York, 1966, p. 100 (3 pages).
A. H. Stone, *Metrizability of Decomposition Spaces*, Proc. Amer. Math. Soc., vol. 7, 1956, pp. 690–700.
P. Urysohn, *Zum Metrisationsproblem*, Math. Ann., vol. 94, 1925, pp. 309–315.
J. Perry and S. Lipscomb, *The generalization of Sierpinski's Triangle that lives in 4–space*, Houston Journal of Mathematics, vol. 29, No. 3, 2003, pp. 691–710.

WEB STRUCTURE AND METHOD FOR MAKING THE SAME

CROSS-REFERENCE TO RELATED APPLICATIONS

The present application claims priority on prior U.S. Provisional Application Ser. No. 60/257,094, filed Dec. 22, 2000, and which is incorporated herein in its entirety by reference.

BACKGROUND OF THE INVENTION

The present invention directed to a web structure, and more particularly to a web structure that could be utilized to form structural elements.

Architects, civil and structural engineers conventionally utilize various web structures for supporting, for example, trusses, floors, columns, etc. Typically, web structures form various lattices or framework that support underlying or overlying supports. In this regard, structural engineers are quite familiar with a "Fink truss" (FIG. 2), the geometry of which encodes an approximation of a "Sierpinski triangle" (also known as a 2-web) (FIG. 1).

It has recently been observed that the geometry of the hardest substance known to man, namely diamonds, and the modern roof truss encode and represent the approximations to certain fractals. The Fink truss (FIG. 2) is an engineering design that is a level-1 2-web. In the nature, carbon-carbon bonding in diamond encodes a level-1 3-web.

A structure resembling the Sierpinski triangle has been useful to structural engineers because each member or edge 110, 112 and 114 at level-0 (FIG. 1) can be braced at its midpoint 116, 118 and 120, respectively, (level-1 represents the "midpoint bracing" of level-0.) For example, consider a standard wooden 8-foot 2"×4." As a stud in the wall of a house, it will buckle at a certain load L. But the (engineering) buckling equations explain that when that same 2×4 is braced in the middle, it can carry as much as four times the load L. In other words, with very little extra material, we can make a much stronger column by simply bracing in the middle. It is noted, however, that the Sierpinski triangle is the limit curve of this bracing in the middle process, e.g., a level-2 approximation (FIG. 3) is obtained by bracing each member (in the middle) of the level-1 approximation, a level-3 approximation (FIG. 4) is obtained by further bracing each member (in the middle) of the level-2 approximation, and so on ad infinitum.

Turning to diamonds, I recently observed that the diamond lattice encodes the "Sierpinski Cheese," which is also called a 3-web (FIG. 7). Relative to the 2-web, we can think of the diamond lattice as encoding four "Fink trusses" (level-1 2-webs), one in each face of a tetrahedron—in FIG. 8, the bracing members 122(A–C), 124(A–C), 126(A–C) and 128(A–C) expose four level-1 2-webs (Fink trusses).

The macro-scale observation that bracing in the middle greatly increases strength may also be observed on the micro scale. In the case of diamonds, the cabon-cabon bonding distance (distance between two carbon atoms that share a covalent electron) is 154.1 pm (one pm=$10^{-12}$ meters). In contrast, silicon exhibits the same diamond lattice structure as diamond, but the silicon-silicon bonding distance is 235.3 pm. Thus, again strength in the case of compressive and tensile forces is directly related to distance (compression and tension at these scales are virtual, i.e., the edges in the diamond lattice (FIG. 7) resist being made shorter (compression) and resist being made longer (tension). The bonding provides "electrostatic balance."

All of these fractals, the 2-web (limit of Fink truss concept), the 3-web (limit of the diamond lattice concept) provide for adjusting the distances of the compression and tension members by middle bracing. It is a mathematical fact (since we are dealing with line segments) that we can middle brace and never worry about the braces at one level obstructing the braces at the next level. In practice, however, the scales and sizes of the materials used for edges may affect the limit of these fractal designs.

In summary, the Fink truss, which is a level-1 Sierpinski triangle, has been utilized for many years in constructing various support structures. To date, diamond which has the geometry of a level-1 Sierpinski cheese as its basic building structure is known to be the hardest structure. The inventor of the present invention has discovered a geometrical structure that represents the next step.

OBJECTS AND SUMMARY OF THE INVENTION

The principal object of the present invention is to provide a web structure which could be utilized at both macroscopic and microscopic levels to create harder than diamond, and stronger and stable structures. On a microscopic scale, for example, a web structure made in accordance with the present invention would produce new compounds and new crystals. On a macroscopic scale, for example, a web structure made in accordance with the present invention would create super strong and stable architectural and structural support structures. For example, a web structure of the present invention can be utilized to create super strong and stable trusses, beams, floors, columns, panels, airplane wings, etc.

Another object of the present invention is to provide the scientific and solid-state physics communities with access to new fundamental web-structure designs that would indicate how to build new compounds and new crystals having utility, for example, in the solid-state electronics industry.

Yet another object of the present invention is to provide a web structure that accommodates or packs more triangular shapes into a given volume than conventional web structures. A web structure made in accordance with the present invention could be used in building bridges, large buildings, space-stations, etc. In the space-station case, for example, a basic, modular and relatively small web structure can be made on earth, in accordance with the present invention, and a large station could be easily built in space by shipping the relatively small web into space, and then joining it with other members to complete the station.

An additional object of the present invention is to provide a web structure that represents a 4-web in a 3-dimensional space.

Yet an additional object of the present invention is to provide a web structure that at level-1 packs or accommodates ten Fink trusses.

A further object of the present invention is to provide a 4-web structure which packs or accommodates more triangles in a given volume than the corresponding 3-web structure.

In summary, the main object of the present invention is to represent a 4-web in a 3-dimensional space. The invention can be utilized to generate new structural designs that relate to both macroscopic and microscopic structures. These structures would be stronger and more stable than the presently known structures, including diamond.

In accordance with the present invention, a web structure includes a generally hexahedron-shaped frame having a plurality of vertices oriented in a manner that no more than three vertices lie in a common plane. Each pair of the vertices is connected by a line or frame segment.

In accordance with the present invention, a web structure includes a generally hexahedron-shaped outer member having first, second, third, fourth, and fifth vertices. A plane includes the third, fourth, and fifth vertices and the first and second vertices are spaced away from the plane. A plurality of generally hexahedron-shaped inner members, having the same general configuration as the outer member, are disposed in the outer member.

In accordance with the present invention, a method of forming a web structure, includes providing a plurality of generally hexahedron-shaped frames, wherein each of the frames includes a plurality of vertices oriented in a manner that no more than three vertices lie in a common plane. Each pair of the vertices in a hexahedron-shaped frame is connected by a line or frame segment. A plane includes three of the five points and one line or frame segment having first and second ends, passes through the plane. The first and second ends of the one line or frame segment are generally equidistant from the plane. The frames are arranged in a side-by-side manner such that one of the three points in the plane of a frame contacts one of the three points in the plane of an adjacent frame. A plurality of the frames are further arranged in a manner that one of the first and second ends of the one line or frame segment of a frame contacts the other of the first and second ends of the one line or frame segment of an adjacent frame.

In accordance with the present invention, a method of forming a web structure, includes providing a plurality of generally hexahedron-shaped members. Each of the members includes first, second, third, fourth, and fifth vertices. A plane includes the third, fourth, and fifth vertices and the first and second vertices are spaced away from the plane. A plurality of the members are arranged in a side-by-side manner in a manner such that one of the third, fourth, and fifth vertices of a member contacts one of the third, fourth, and fifth vertices of an adjacent member. A plurality of the members are further arranged in a manner that one of the first and second vertices of a member contacts the other of the first and second vertices of an adjacent member.

BRIEF DESCRIPTION OF THE DRAWINGS

The patent or application file contains at least one drawing executed in color. Copies of this patent or patent application publication with color drawings(s) will be provided by the U.S. Patent and Trademark Office upon request and payment of the necessary fee.

The above and other objects, novel features and advantages of the present invention will become apparent from the following detailed description of the invention, as illustrated in the drawings, in which.

DETAILED DESCRIPTION OF THE INVENTION

A 2-web may be viewed as a systematic packing of triangles inside of a triangle. Approximations to 2-webs occur at levels, i.e., there is a level-0 2-web, a level-1 2-web, a level-2 2-web, a level-3 2-web, a level-4 2-web, a level-5 2-web, etc. (See FIGS. 1-6). The building and trades industry uses designs involving triangles as the fundamental construct; and, in particular, the building or design of a roof truss is packing triangles inside of triangles. Thus, in general, a 2-web is a design for packing triangles in a 2-dimensional space, i.e., in a plane.

A 3-web may likewise be viewed as a systematic packing of tetrahedra inside of a tetrahedron. And since a tetrahedron is a systematic packing of four triangles, it can be observed that a 3-web is a way to pack triangles into a 3-dimensional space. And, also like 2-webs, 3-web approximations occur at levels, namely, level-0, level-1, level-2, level-3, etc. (See FIGS. 7-10).

Figure 1:
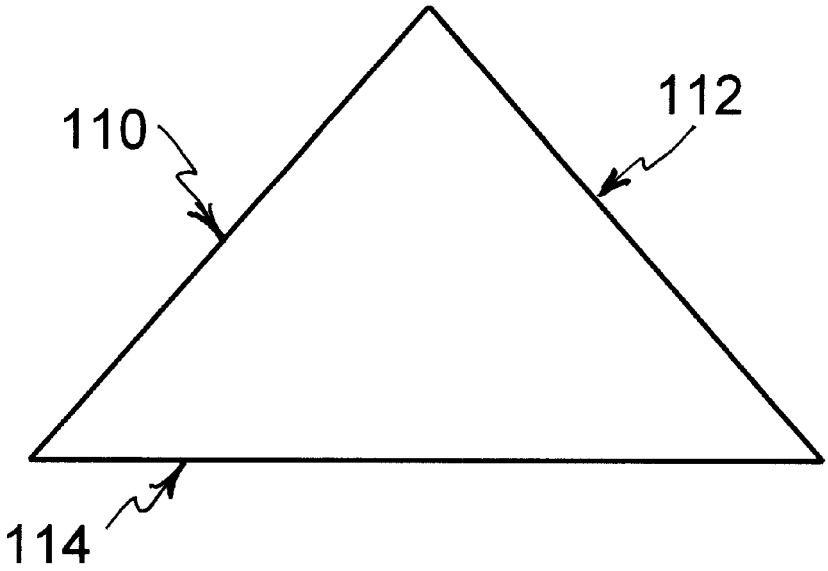
FIG. 1 (PRIOR ART)
FIG. 1 illustrates a Sierpinski's triangle or a level-0 2-web.
Figure 2:
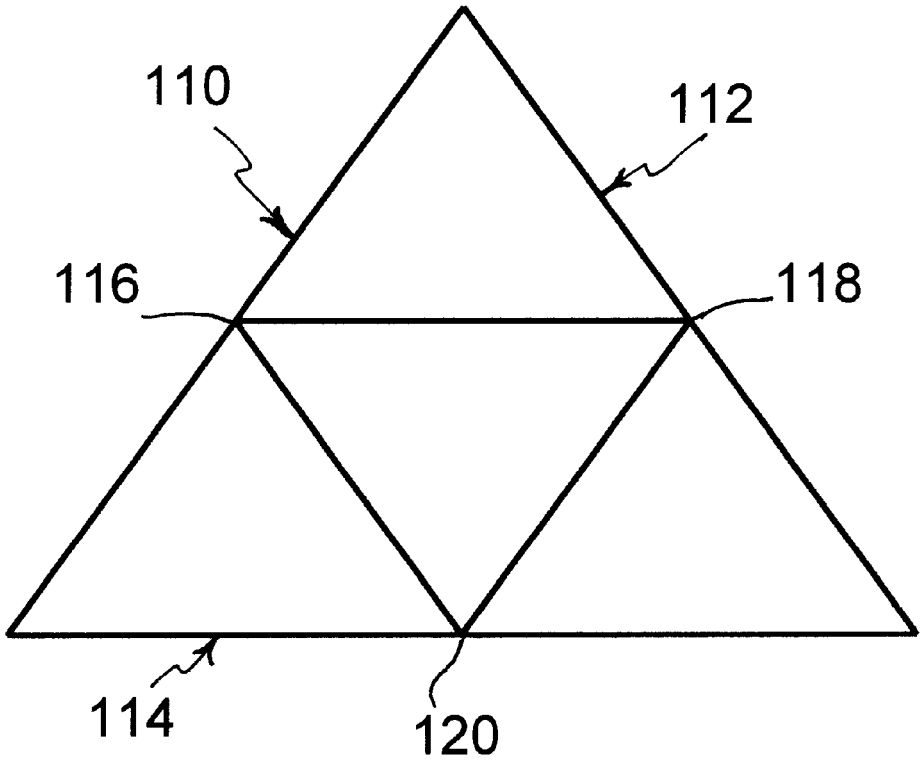
FIG. 2 (PRIOR ART)
FIG. 2 illustrates a Fink truss or a level-1 2-web.
Figure 3:
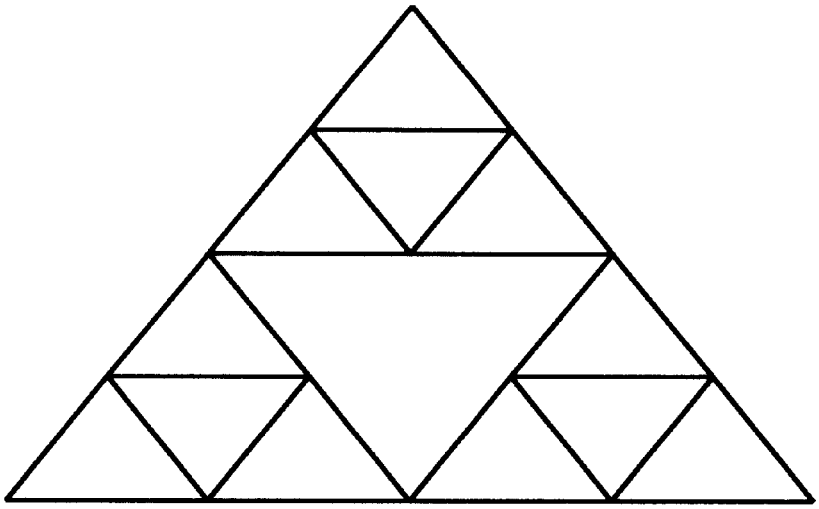
FIG. 3 (PRIOR ART)
FIG. 3 illustrates a level-2 2-web.
Figure 4:
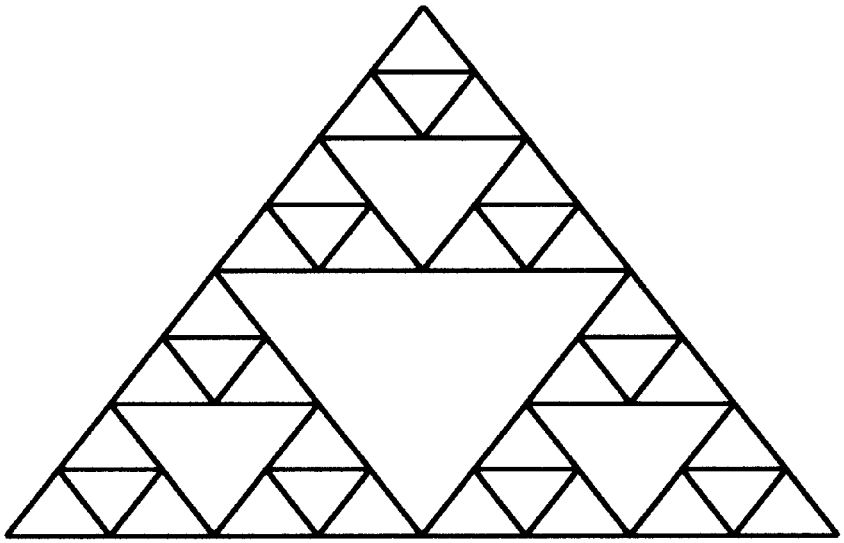
FIG. 4 (PRIOR ART)
FIG. 4 illustrates a level-3 2-web.
Figure 5:
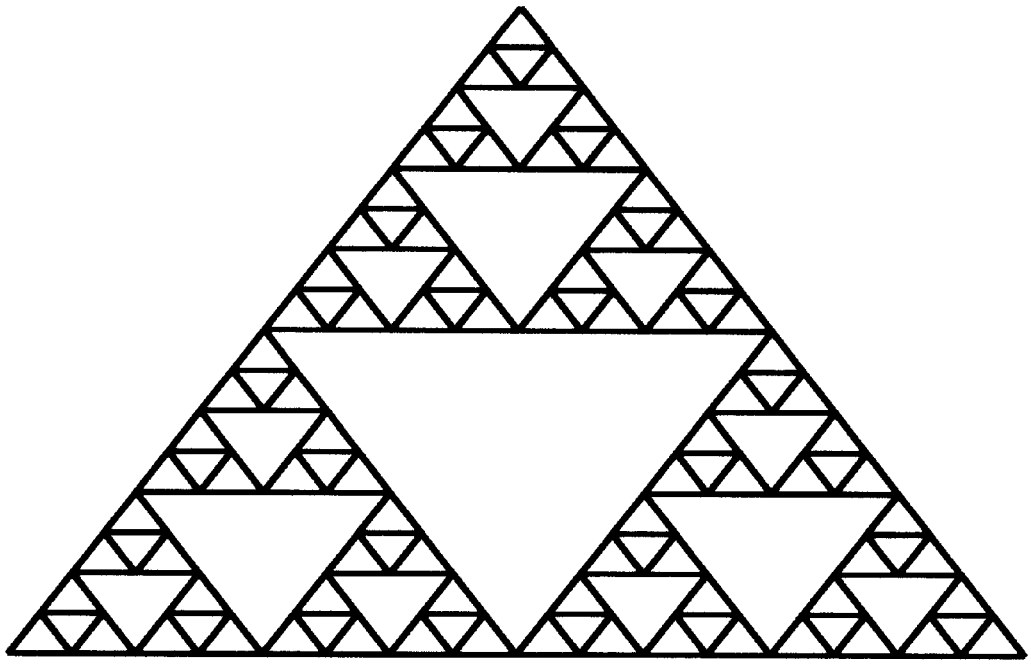
FIG. 5 (PRIOR ART)
FIG. 5 illustrates a level-4 2-web.
Figure 6:
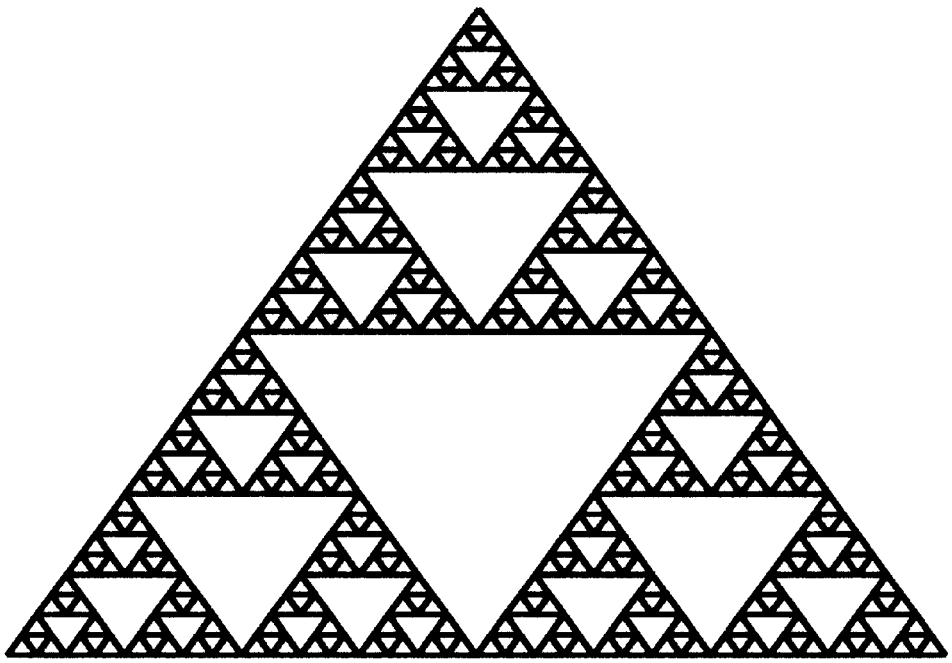
FIG. 6 (PRIOR ART)
FIG. 6 illustrates a level-5 2-web.
Figure 7:
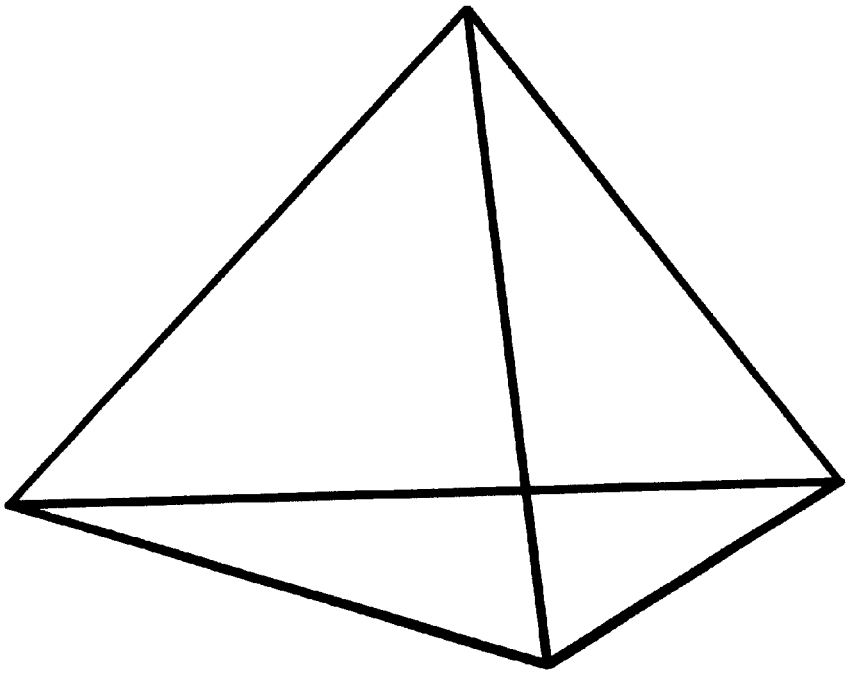
FIG. 7 (PRIOR ART)
FIG. 7 illustrates a level-0 3-web.
Figure 8:
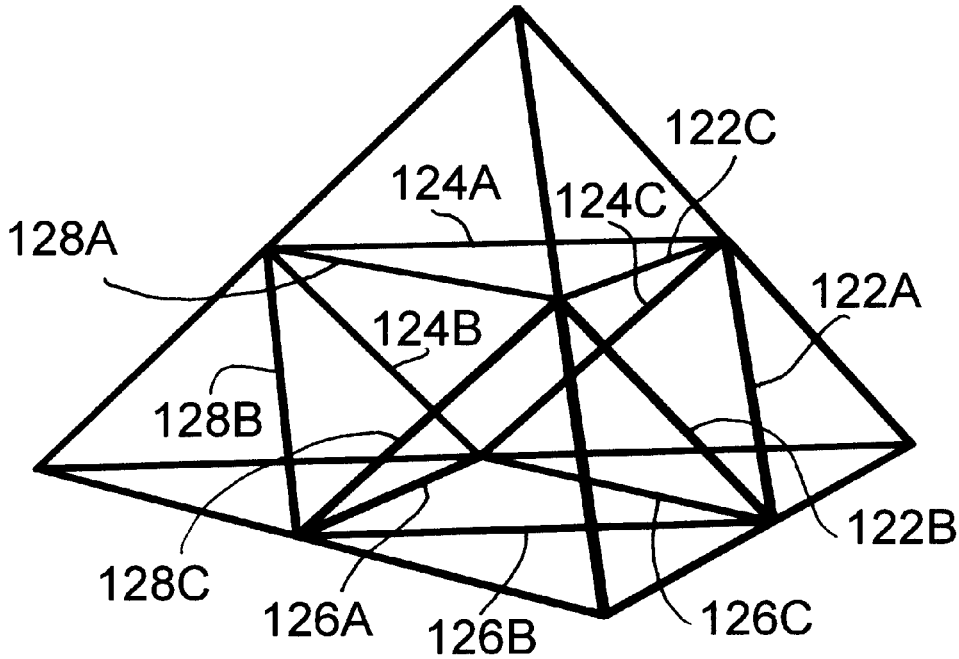
FIG. 8 (PRIOR ART)
FIG. 8 illustrates a level-1 3-web.
Figure 9:
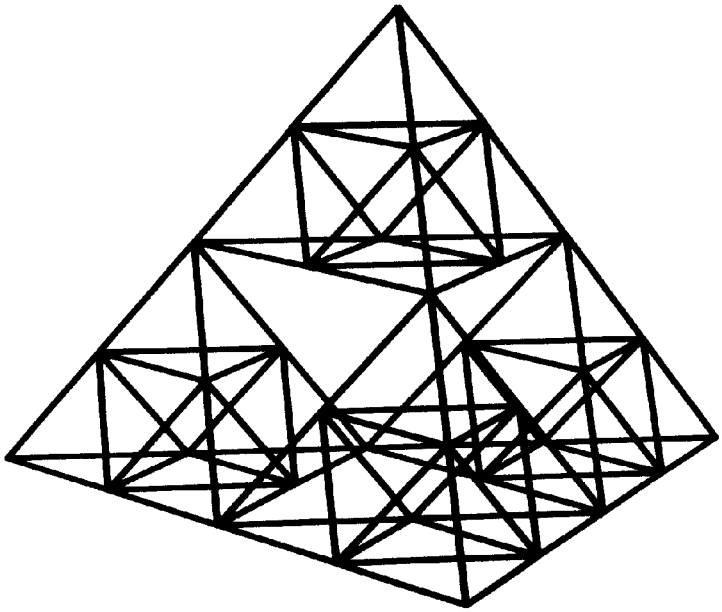
FIG. 9 (PRIOR ART)
FIG. 9 illustrates a level-2 3-web.

Moreover, let us start with the four triangles (faces) that define a level-0 3-web as illustrated in FIG. 7. If we add edges or line (frame) segments to obtain a higher level 3-web, as illustrated in FIG. 8, then we can easily observe that each of the original four triangles (faces) together with the additional edges contained in these four faces form a higher level 2-web. That is, the 3-web systematic packing of triangles is an extension of the 2-web systematic packing.

Figure 23:
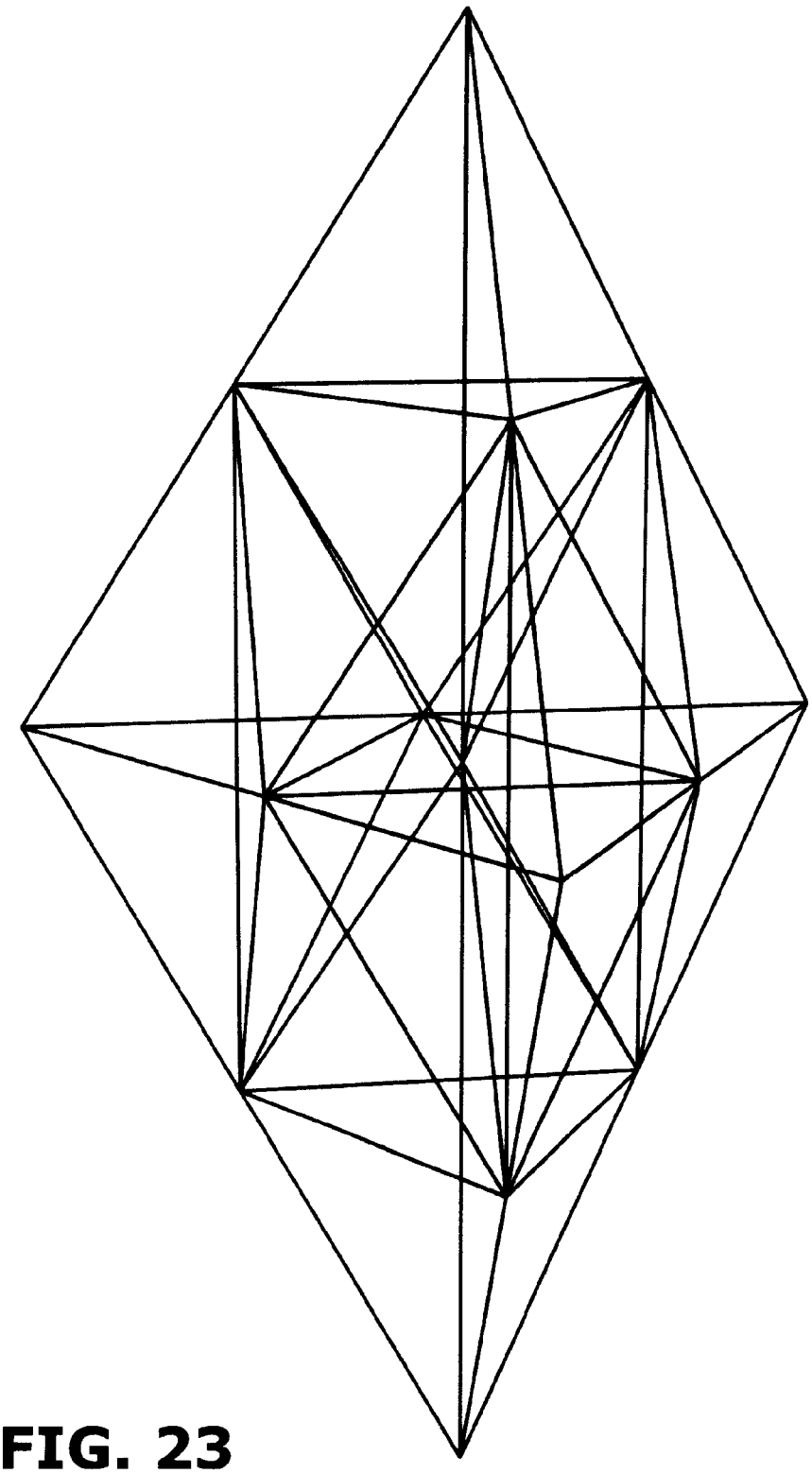
FIG. 23 illustrates a level-1 4-web structure formed in accordance with the present invention.

This relationship between 2-webs and 3-webs carries over to a similar relationship between 3-webs and 4-webs. For example, in FIG. 23, we see a level-1 4-web and we see several level-1 3-webs. Thus, it can be observed that a level-1 4-web packs more triangles in a given volume than the corresponding level-1 3-web.

Figure 10:
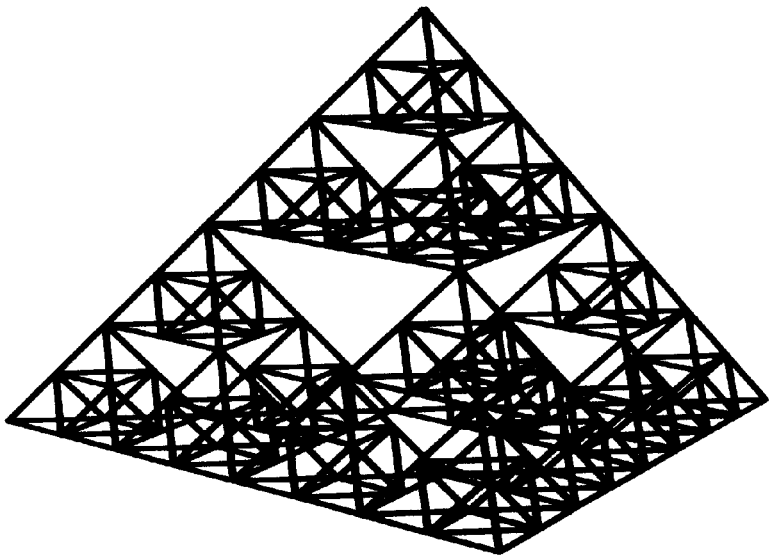
FIG. 10 (PRIOR ART)
FIG. 10 illustrates a level-3 3-web.
Figure 10A:
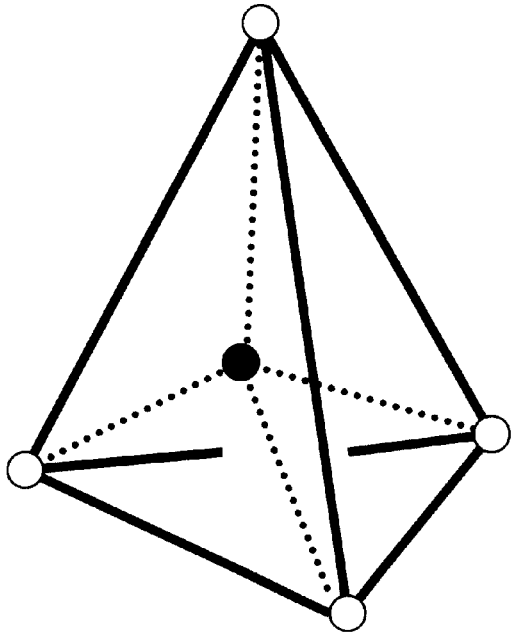
FIG. 10A (PRIOR ART)
FIG. 10A illustrates a tetrahedron structure of carbon in diamond crystal.
Figure 10B:
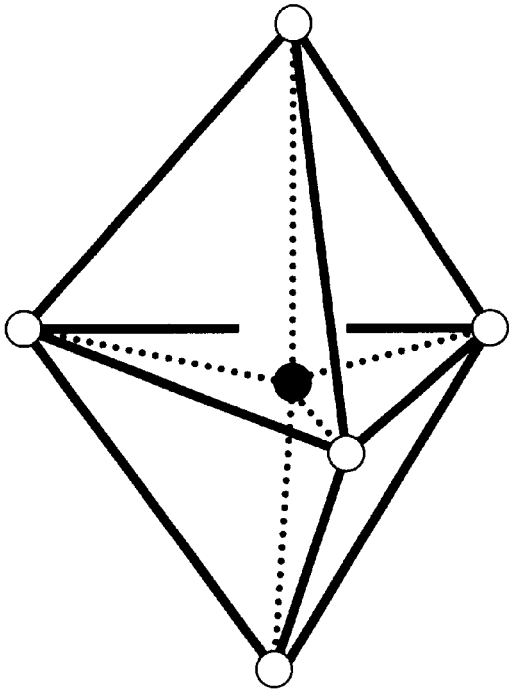
FIG. 10B (PRIOR ART)
FIG. 10B illustrates the hexagonal structure of a phosphorous atom.
Figure 10C:
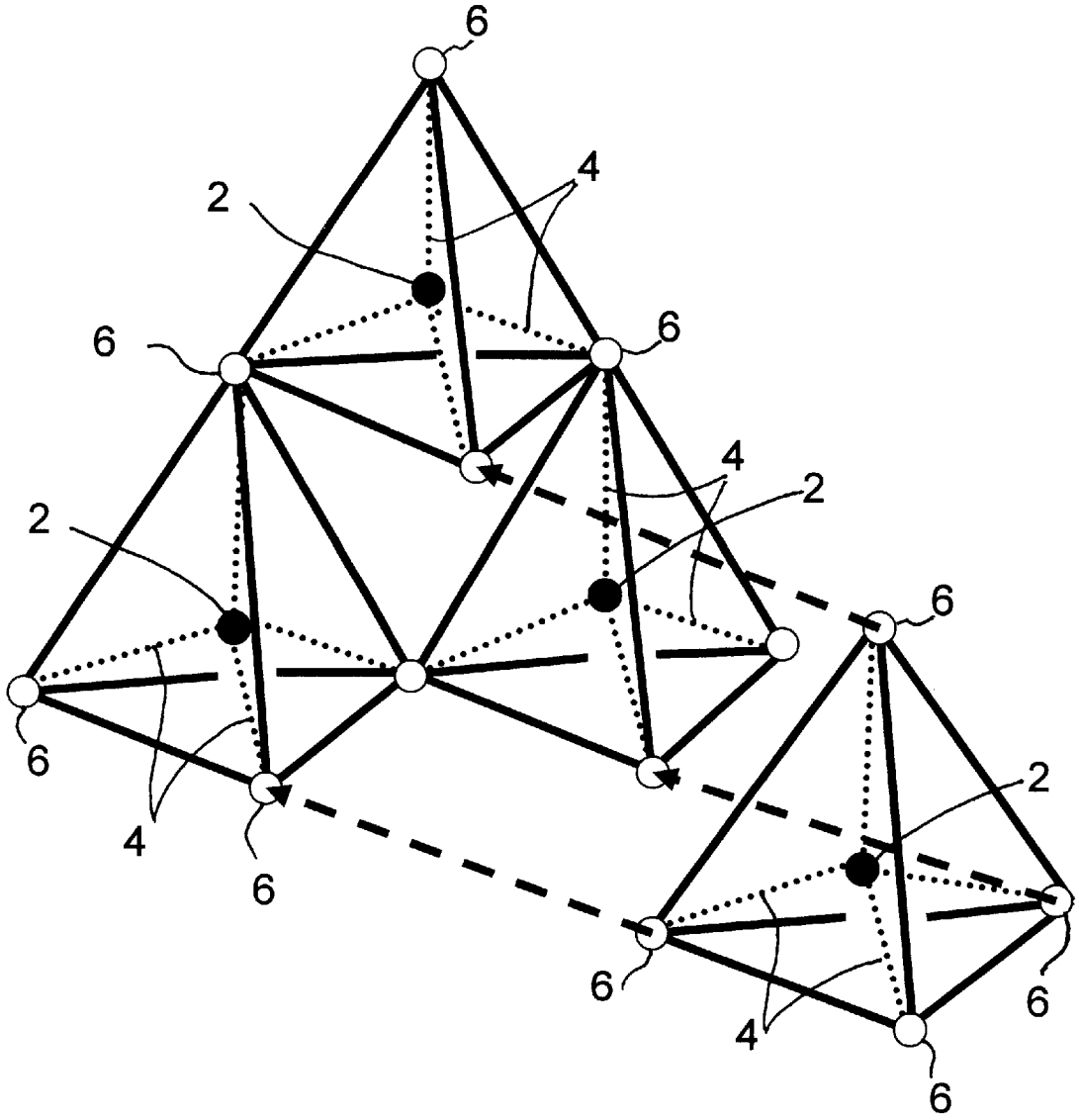
FIG. 10C (PRIOR ART)
FIG. 10C illustrates joining of four tetrahedra to form a level-1 3-web or diamond crystal lattice.

As an example of how the 3-web encodes the diamond-lattice structure, FIG. 10A shows a tetrahedron induced from a carbon atom. FIG. 10C shows how four such tetrahedra may be joined at their vertices to construct a level-1 3-web (FIG. 8). In FIG. 10C we see (dotted lines) the diamond lattice. Indeed, if we place a carbon atom at the centroid and vertices of each tetrahedron, then this arrangement of carbon atoms represents the building block for the diamond-lattice crystal structure.

In short, 3-webs systematically pack tetrahedra in a 3-dimensional space, and 4-webs (subject of the present invention) systematically pack hexahedra.

Figure 11:
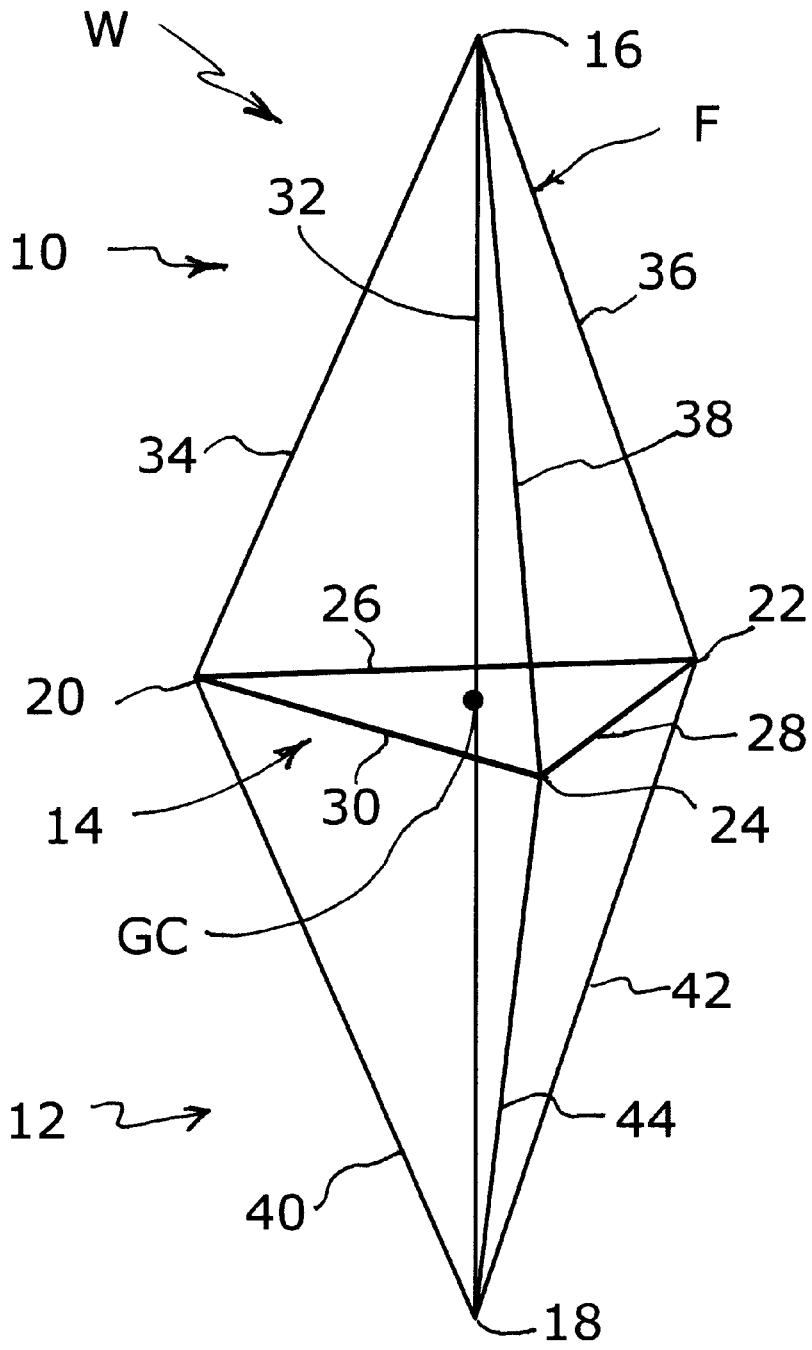
FIG. 11 illustrates a level-0 4-web structure formed in accordance with the present invention.

To understand why a 4-web structure, made in accordance with the present invention, would allow for configurations that yield super strong structures, suppose we view a level-1 2-web as a simple Fink truss. Then, a level-1 3-web (the basic building block encoded in diamond) packs four Fink trusses into the volume of a tetrahedron. However, the 4-web structure of the invention packs ten Fink trusses into the volume of two tetrahedra. Packing ten such optimum (strength/weight)-structures using only five points in three-dimensions is an important, unique aspect of the invention. To understand how this is accomplished, we may consider the level-0 4-web (FIG. 11). It has five vertices 16, 18, 20, 22, and 24, and (5-choose-2)=10 edges or line segments. When each edge or line segment is braced in the middle according to the 4-web design, thereby obtaining the level-1 4-web (FIG. 16), we find that every three of the vertices 16, 18, 20, 22, and 24 in FIG. 11 are the vertices of a Fink truss. Thus, there are (5-choose-3) 10 such Fink trusses in a level-1 4-web.

The 2-web and 3-web are instances of fractals. These fractals have a generalization known as the 4-web. This 4-web was, until recently, believed to exist only in 4-dimensional space. But it is now known that it also exists in 3-dimensional space [Reference No. 3, incorporated herein in its entirety by reference].

From the theoretical view, these fractals are attractors of iterated function systems. In this case, an iterated function system is a finite set of functions, each of which is a contraction by ½ followed by a translation. For the 2-web, there are three functions that act on the plane, for the 3-web there are four functions that act on 3-space, and for the 4-web there are five functions that act on 4-space. The 4-web is the attractor of those five functions that act on 4-space. Thus, the 4-web lives naturally in 4-space. It had been long believed that it was impossible to move the 4-web into 3-space. This belief was perhaps based on the fact that the 3-web cannot be moved into 2-space. There was really no motivation to guess that the 4-web could be moved into 3-space with its fractal dimension preserved. The fact that it is possible to move the 4-web into 3-space was first documented in [Reference No. 3].

And, like the other attractors, the 4-web at any level provides for systematic middle bracing so that no brace gets in the way or obstructs the other brace. This ability to start with one standard and make it stronger and stronger by adding bracing should prove useful. Experiments (discussed below) document the first step in that direction. The Experiments also indicate the direction for the second step, namely, the next step should be optimization. We anticipate automating the process of redistributing the steel among the various members so that optimum performance can be achieved for the application that one has in mind.

The web structure of the present invention in its simplest form (level-0), is best illustrated in FIG. 11. As shown, the web structure W includes a generally hexahedron-shaped frame F including an upper generally triangular or trihedron-shaped sub-frame 10 and a lower generally triangular or trihedron-shaped sub-frame 12. The upper and lower sub-frames 10 and 12 are joined at their bases to form a common equatorial sub-frame 14.

The frame F includes upper and lower points or apices 16 and 18, respectively, and three equatorial points or apices 20, 22, and 24. The points 16, 18, 20, 22, and 24 are oriented in a three-dimensional space in a manner that no more than three points lie in a same plane. The equatorial points 20, 22, and 24 are disposed in a generally common, generally horizontal plane represented by equatorial sub-frame 14.

As illustrated in FIG. 11, each pair of the points 16, 18, 20, 22, and 24, is connected by a line or frame segment. For instance, equatorial points 20 and 22 are connected by a frame segment 26, the equatorial points 22 and 24 are connected by a frame segment 28, and equatorial points 20 and 24 are connected by a frame segment 30. Likewise, upper and lower points 16 and 18 are connected by a frame segment 32. In the same manner, the points 16 and 20, 16 and 22, 16 and 24, 18 and 20, 18 and 22, and 18 and 24, are connected by frame segments 34, 36, 38, 40, 42, and 44, respectively.

The frame segment 32 is disposed preferably generally perpendicular to the plane of sub-frame 14 and passes generally through the geometrical center thereof. Alternatively, the frame segment 32 may be generally skew or slanted.

The frame F forms ten triangles represented by points 16, 20, and 24; 16, 20, and 22; 16, 22, and 24; 20, 22, and 24; 18, 20, and 24; 18, 22, and 24; 18, 20, and 22; 16,18, and 20; 16, 18, and 22; and 16, 18, and 24. Each of these triangles functions as a Fink truss when each frame segment thereof is braced in the middle.

Preferably, each of the frame segments 26, 28, 30, 32, 34, 36, 38, 40, 42, and 44 is a generally straight segment.

Figure 16:
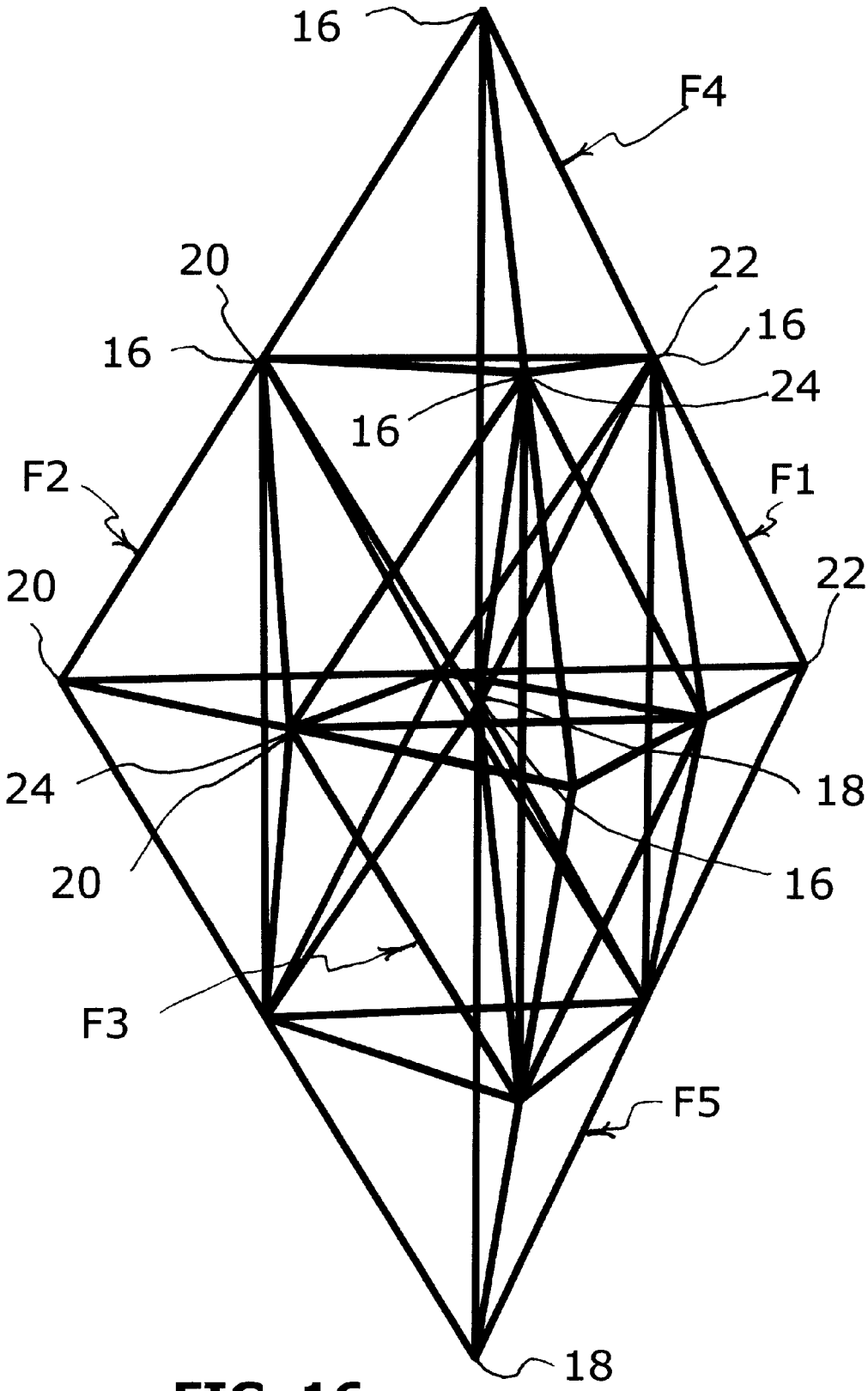
Figure 21:
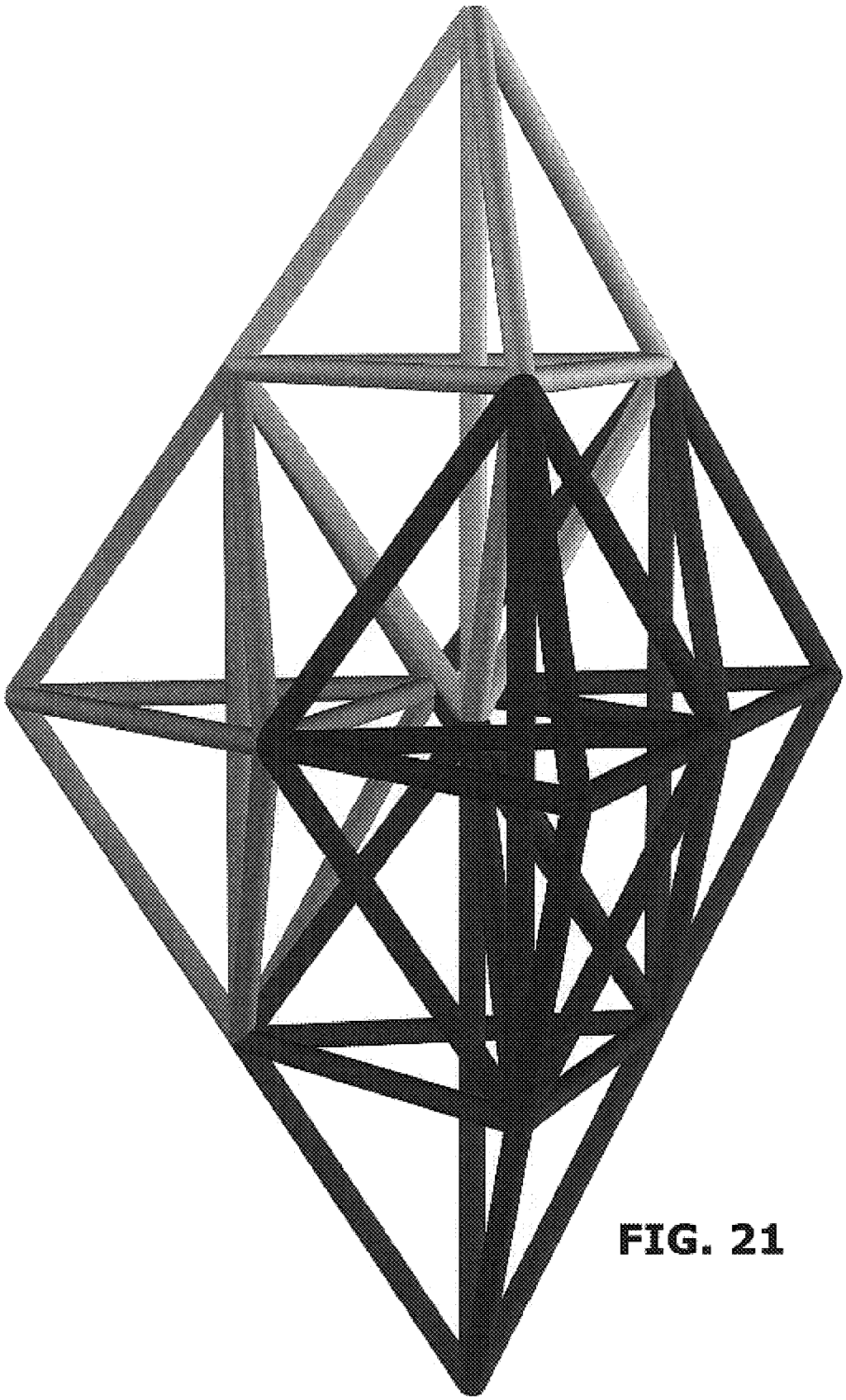
Figure 22:
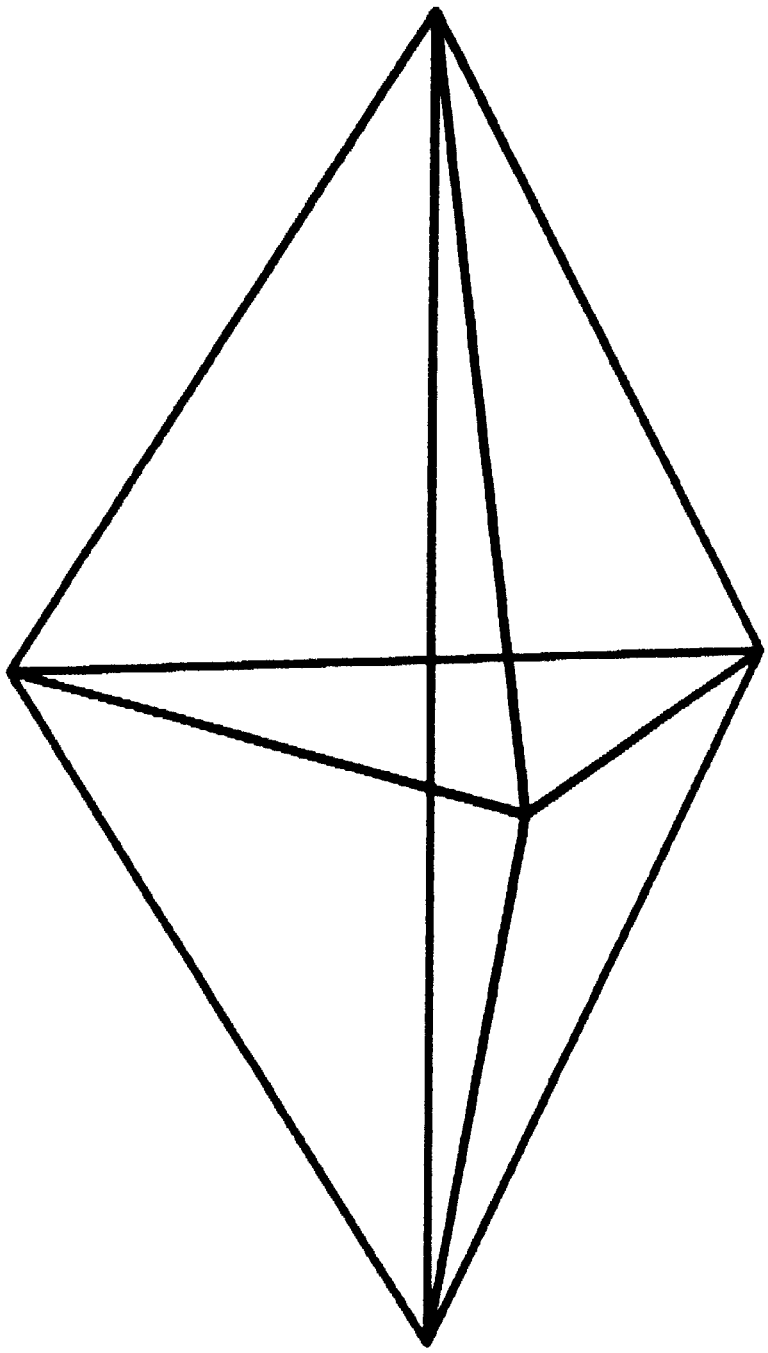
FIG. 22 illustrates a level-0 4-web structure formed in accordance with the present invention.

FIG. 11 represents a level-0 of the web structure W of the invention. The web structure shown in FIG. 11, may preferably be sub-divided to form a level-1, as shown in FIGS. 16 and 21. In other words, the frame F can be structured to provide five inside layer of frames represented by sub-frames $F_1$–$F_5$.

Figure 12:
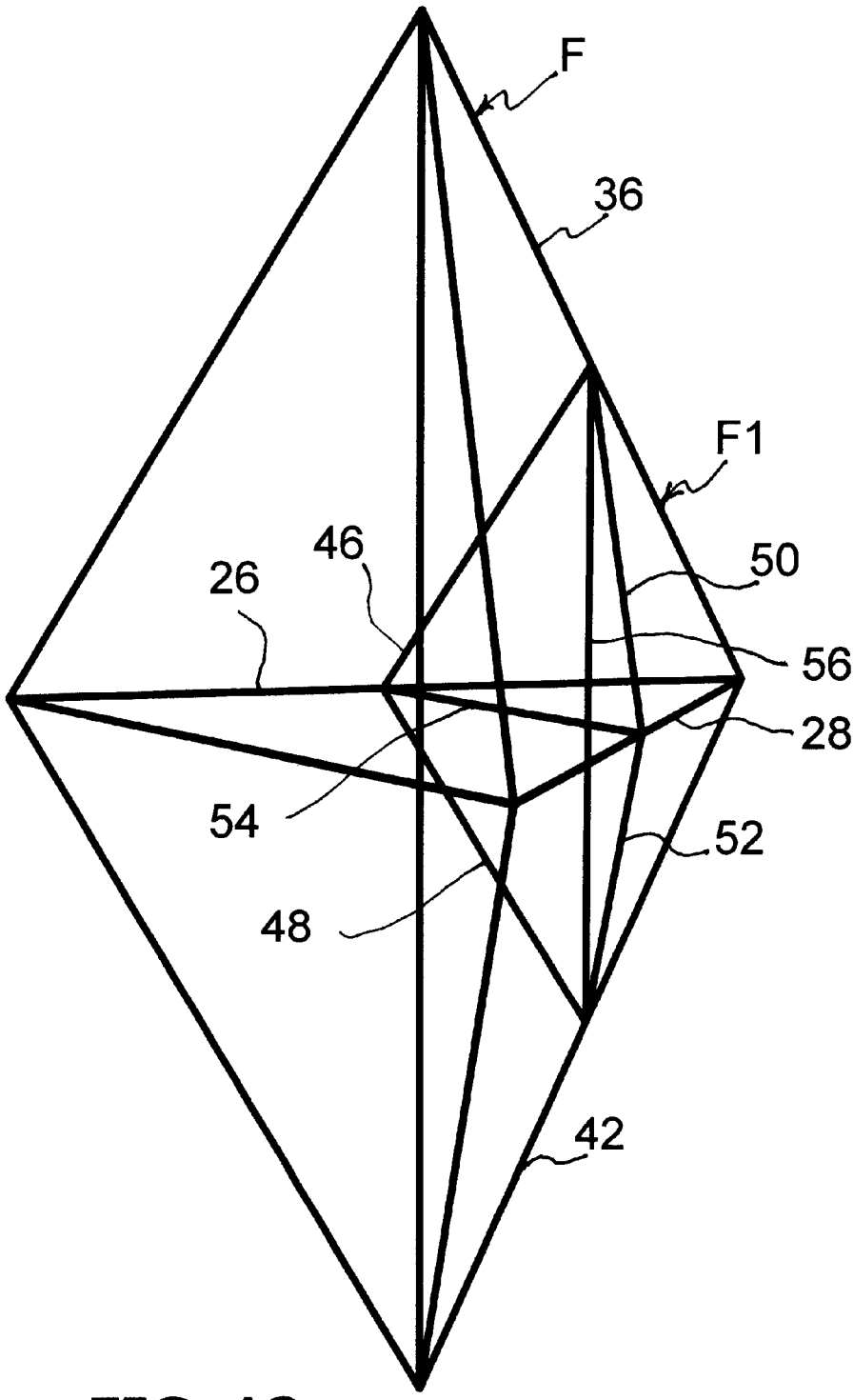
FIGS. 12-16 illustrate a sequence of the formation of a level-1 4-web structure from the web structure shown in FIG. 11.
Figure 13:
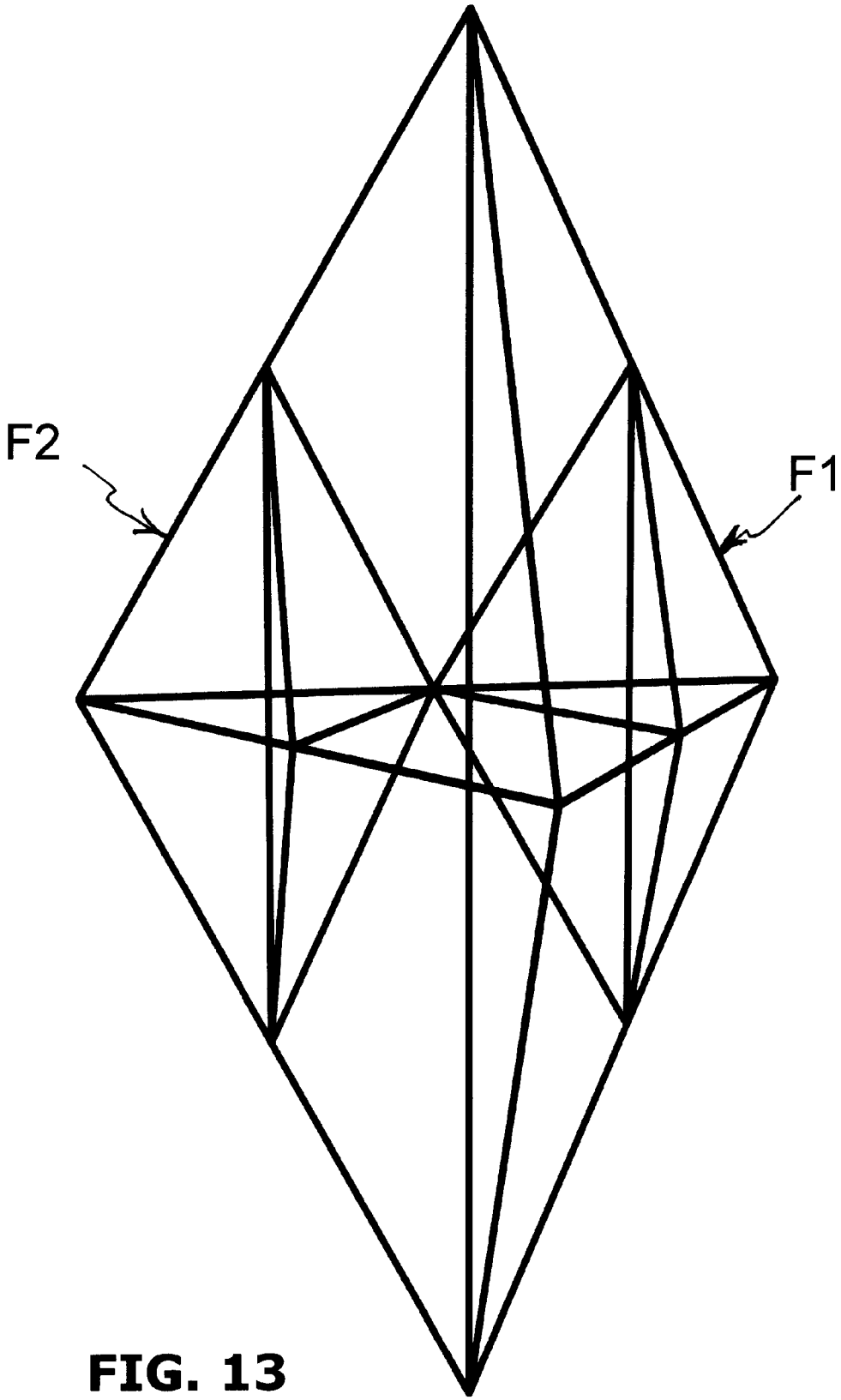
Figure 14:
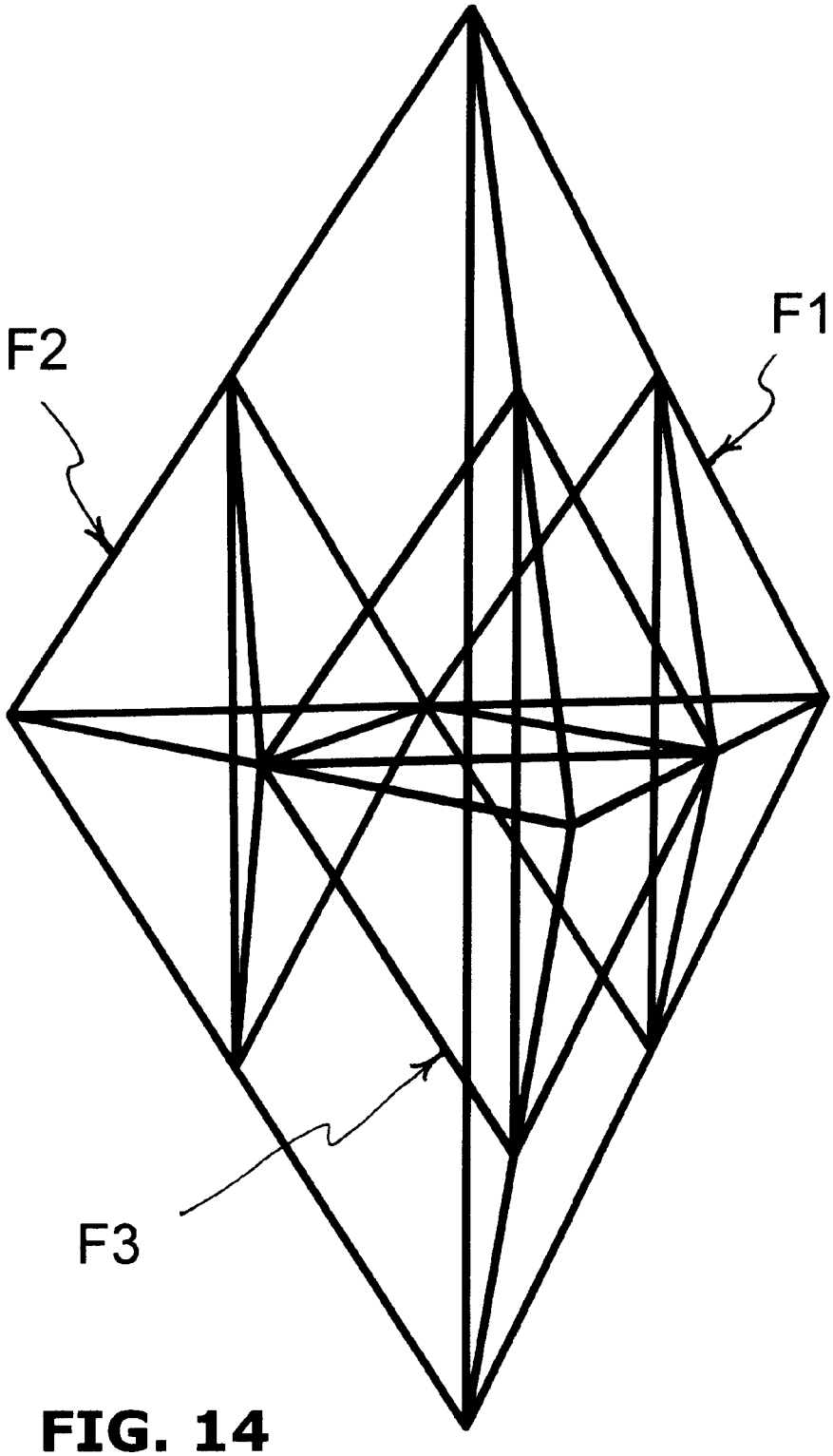
Figure 15:
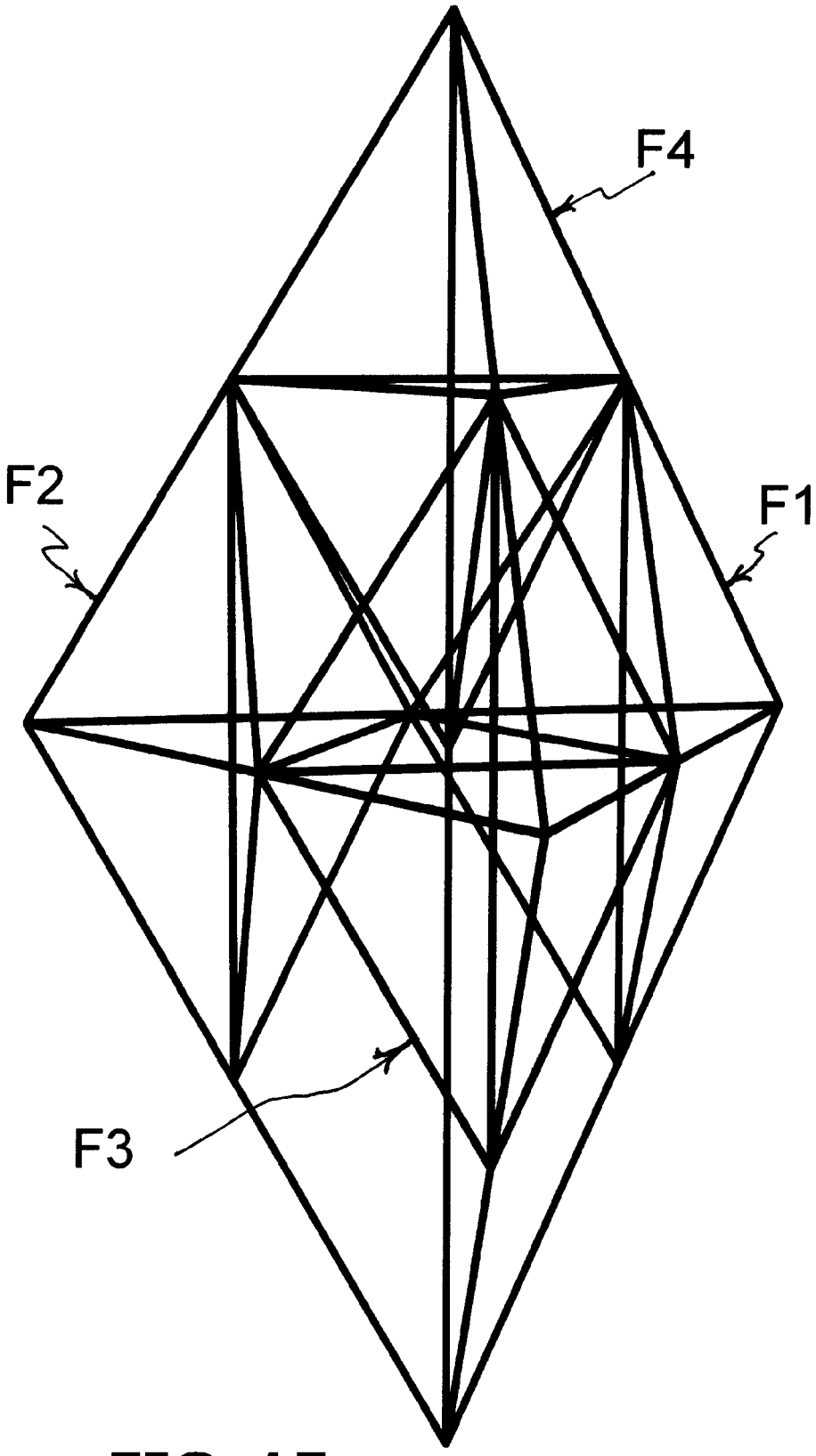
Figure 17:
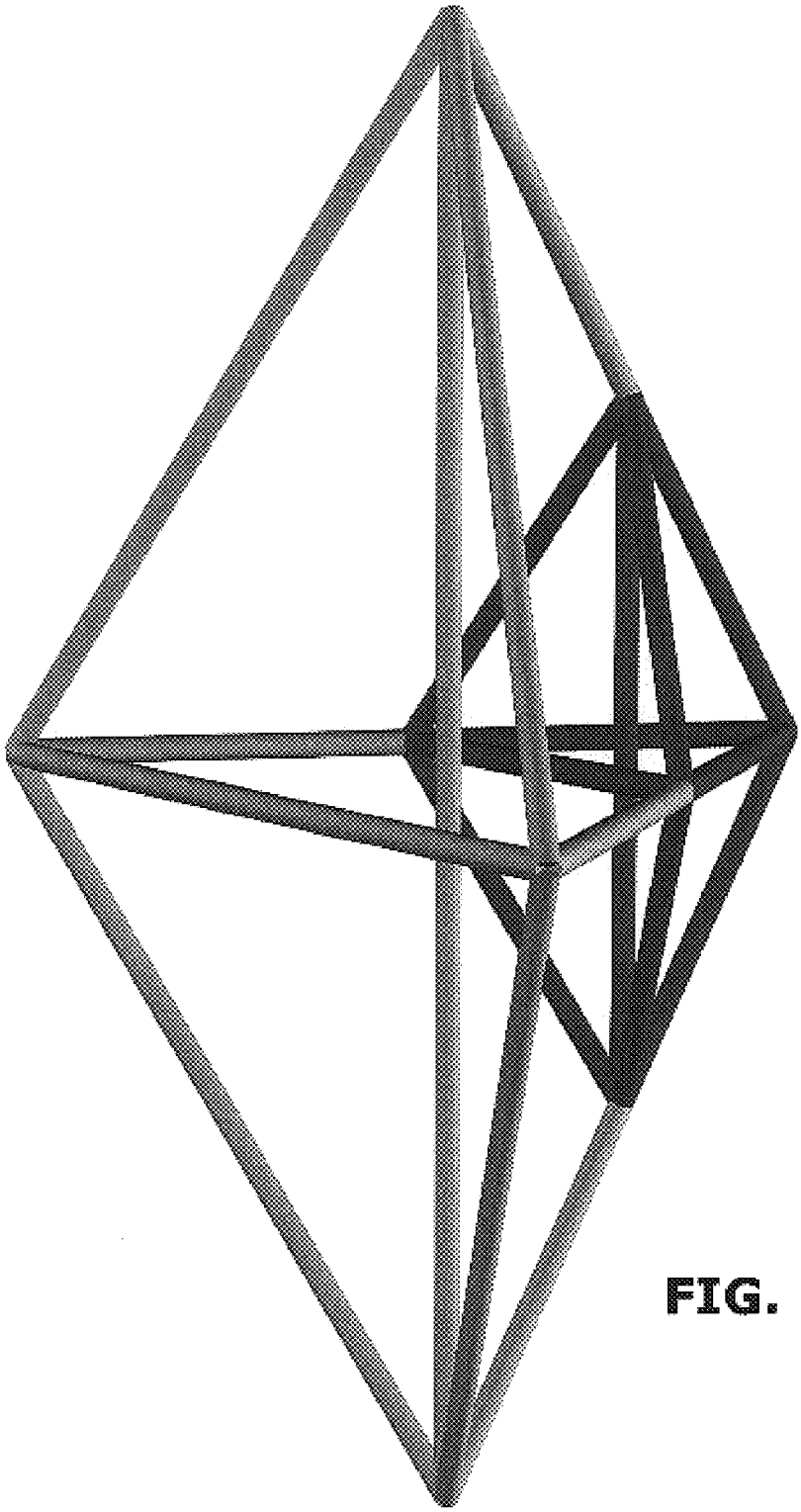
FIGS. 17-21 illustrate in color the sequence of the formation of the level-1 4-web structure, shown in FIGS. 12-16.
Figure 18:
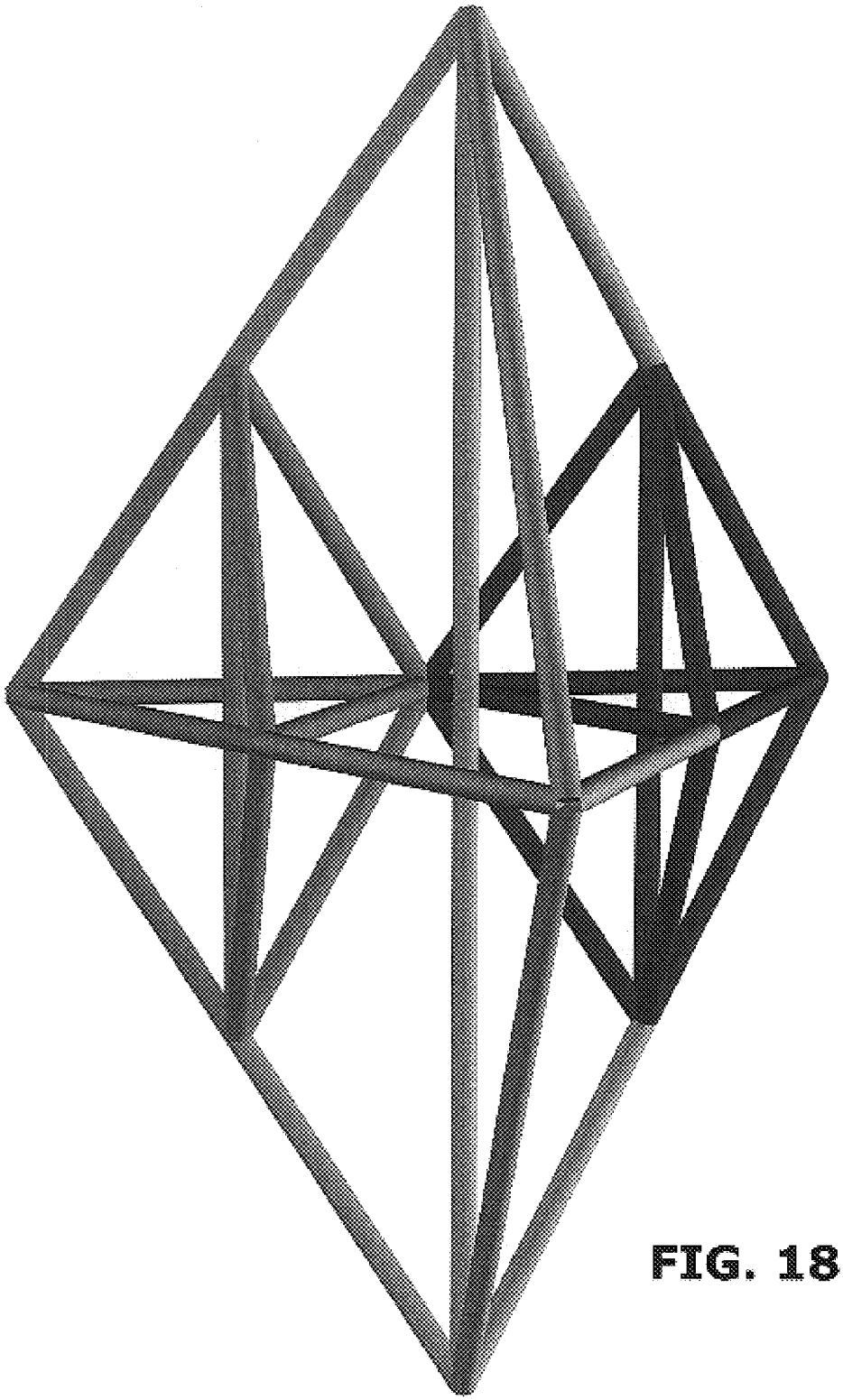
Figure 19:
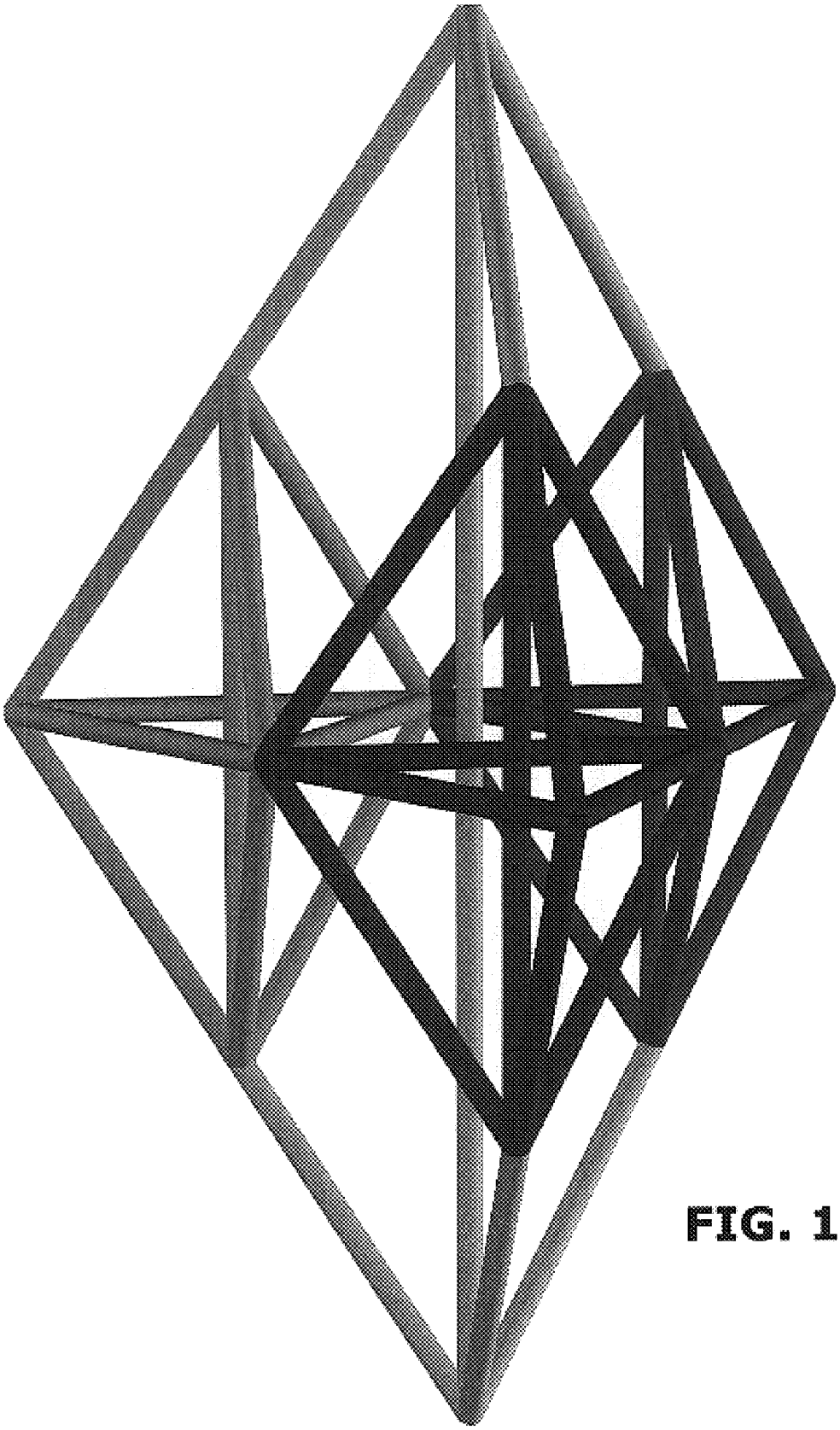
Figure 20:
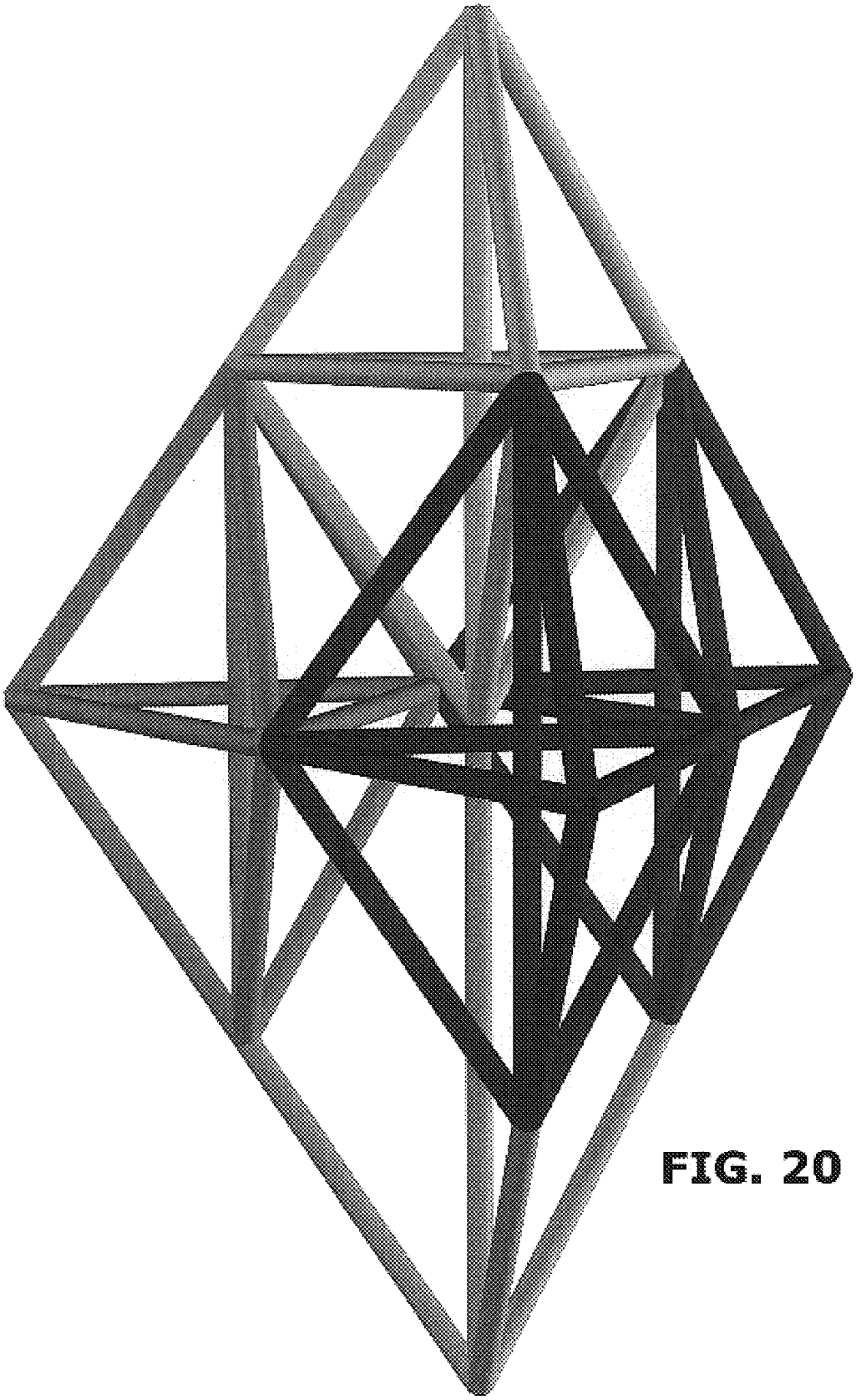
Figure 24:
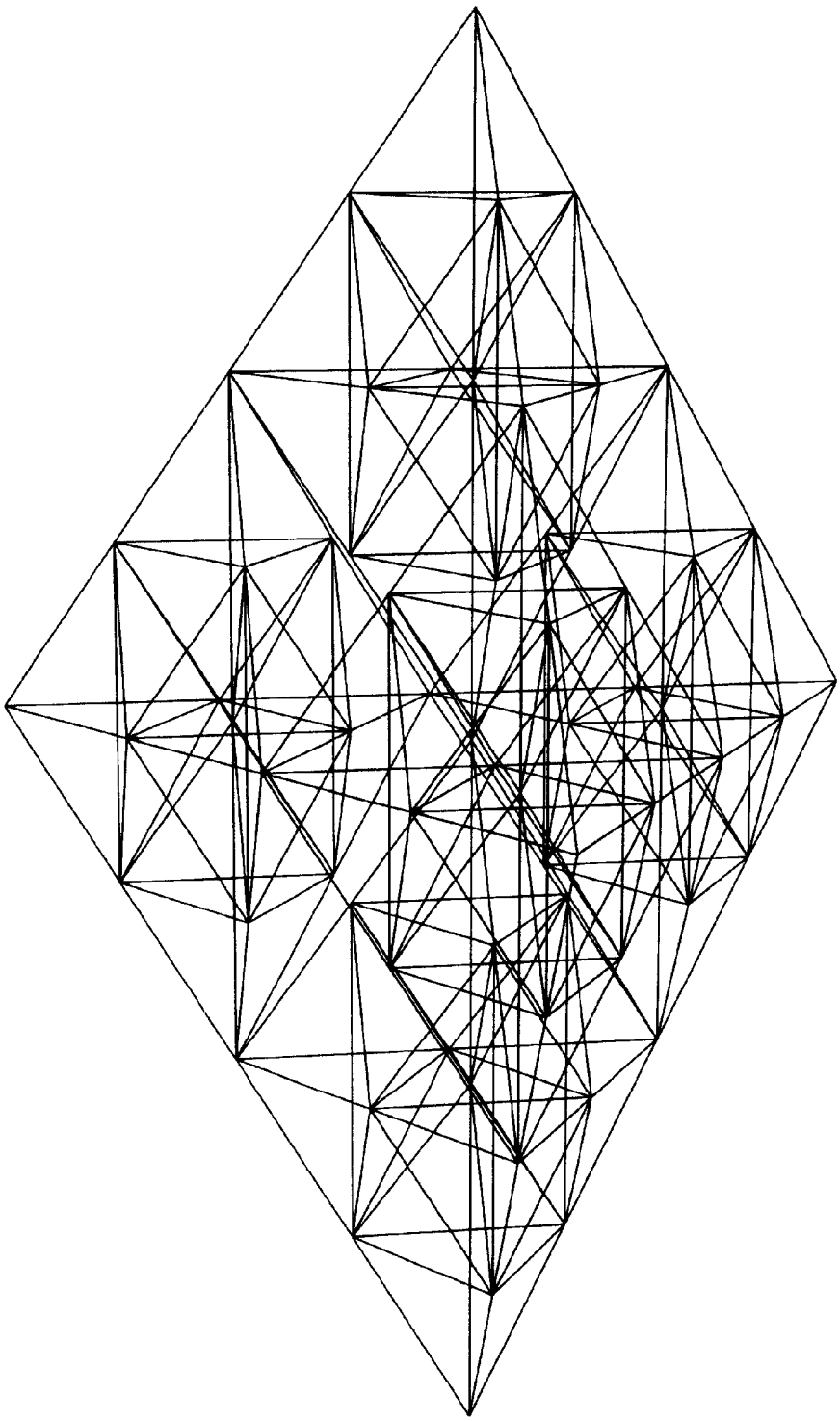
FIG. 24 illustrates a level-2 4-web structure formed in accordance with the present invention.
Figure 25:
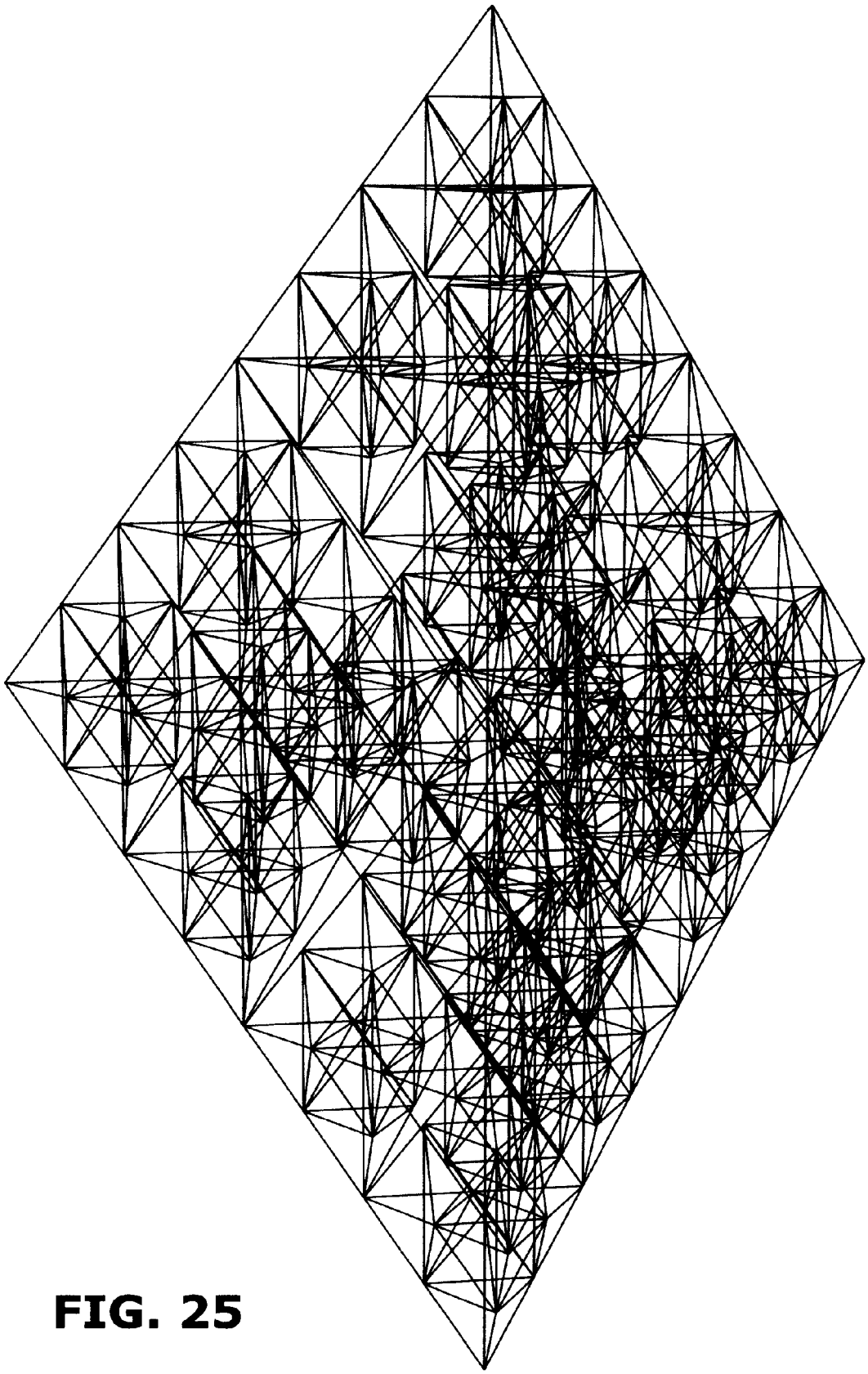
FIG. 25 illustrates a level-3 4-web structure formed in accordance with the present invention.

As illustrated in FIG. 12, by further mid-bracing frame segments 26, 28, 36, and 42, by using frame segments 46, 48, 50, 52, 54, and 56, sub-frame $F_1$ may be formed (see FIG. 17). Likewise, sub-frames $F_2$–$F_5$ may be formed (see FIGS. 13-16 and 18-21). (FIGS. 17-21 show sub-frames $F_1$–$F_5$ in red, green, blue, yellow and purple, respectively.) Each of the sub-frames $F_1$–$F_5$ may be further subdivided in the like manner to provide a level-2 4-web structure or level-3 4-web structure (see FIGS. 24-25). In other words, each frame in any level may be further divided ad infinitum to form a desired level of a web structure. It is noted that each sub-frame $F_1$–$F_5$ is a scaled configuration of frame F.

Figure 26:
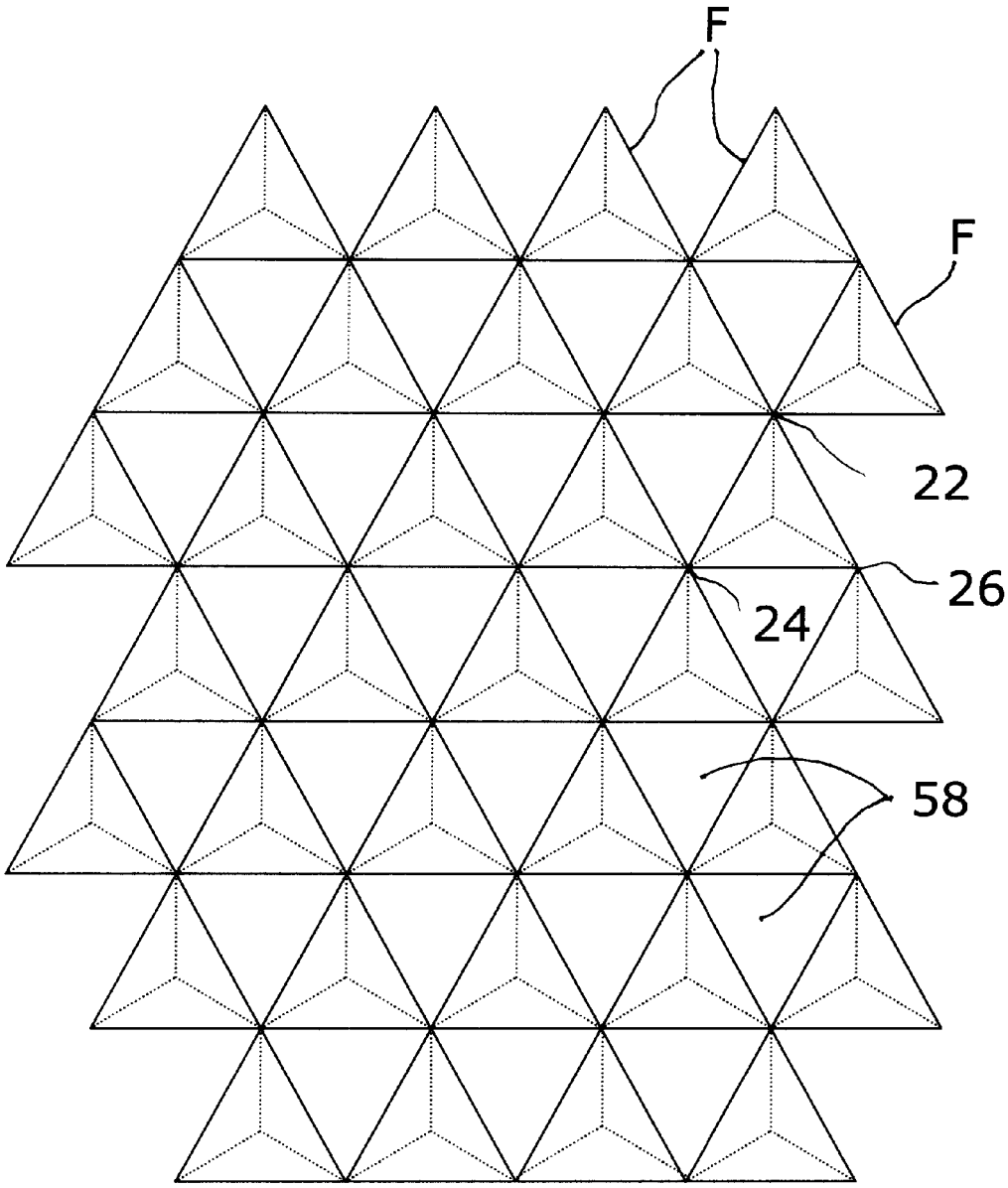
FIG. 26 illustrates a top plan view of a web structure formed by arranging level-0 4-web structures in a side-by-side manner.
Figure 27:
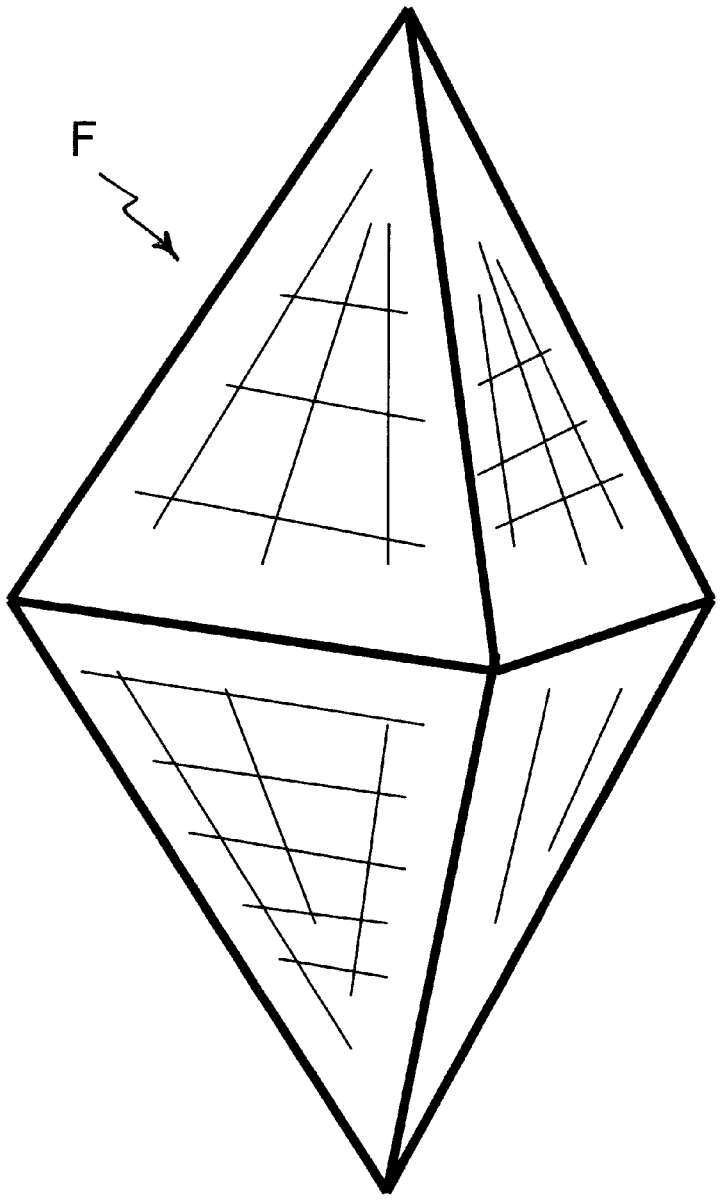
FIGS. 27-30 illustrate the structures of solid level-0 4-web, level-1 4-web, level-2 4-web, and level-3 4-web, respectively.
Figure 28:
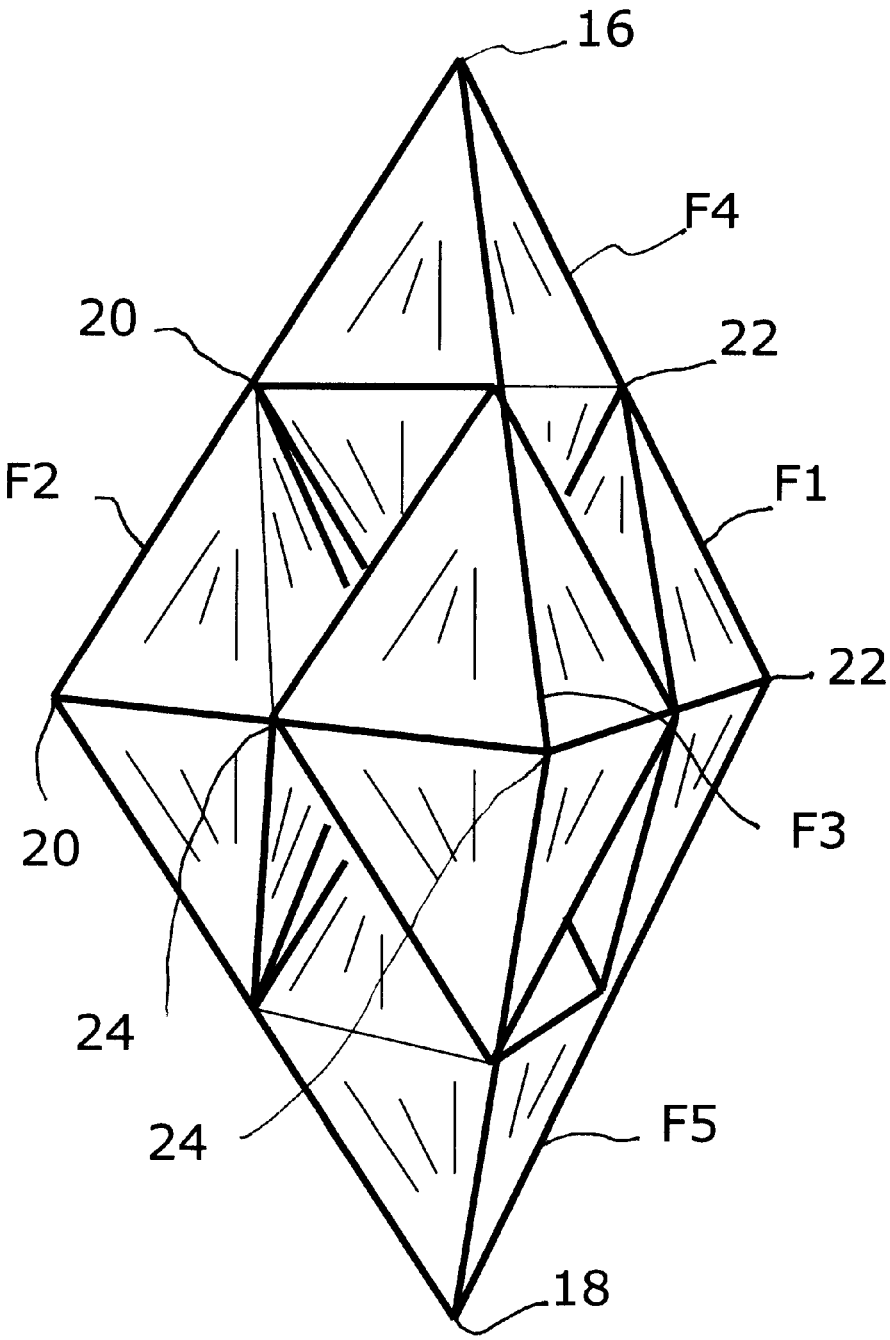
Figure 29:
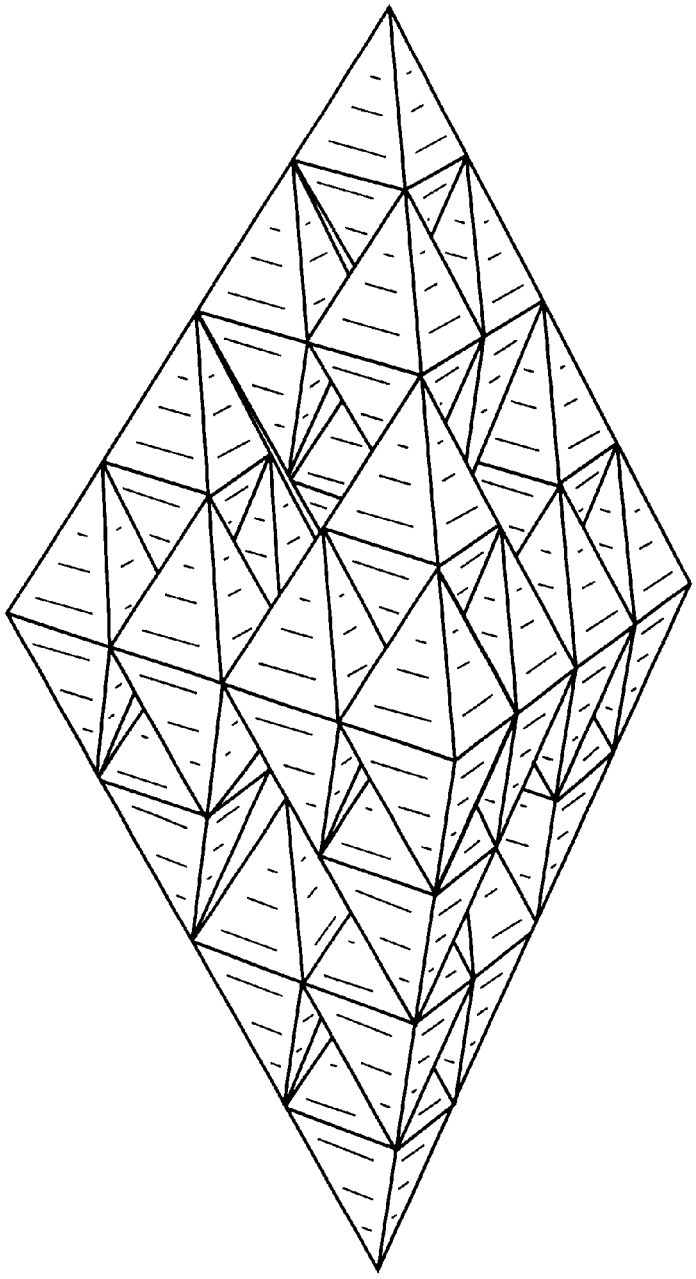
Figure 30:
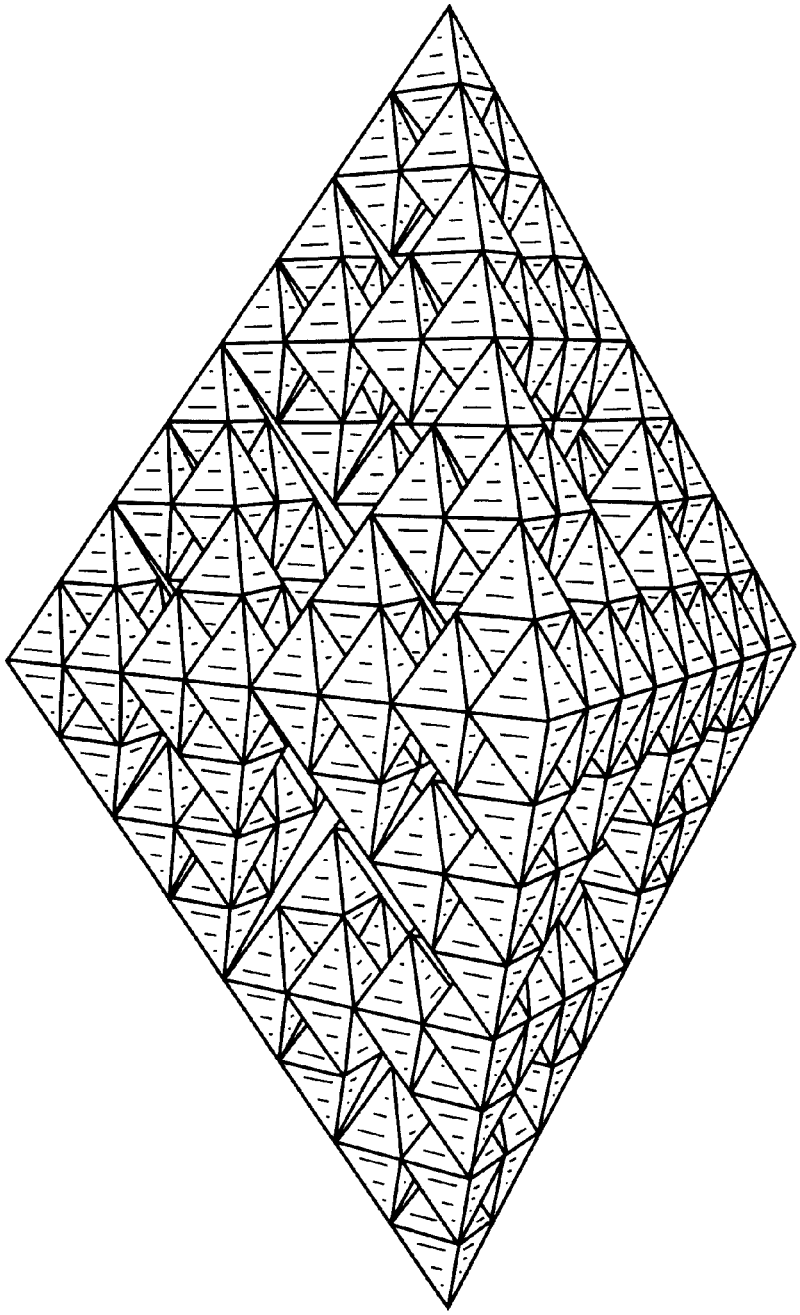

FIG. 26 illustrates an alternative embodiment of the invention, where a panel P may be formed by using the web structure shown in FIG. 11. In particular, several frames F are arranged in a side-by-side relationship in a manner that the equatorial points 20, 22, and 24 of one frame contact the equatorial points of adjacent frames. Another layer of frames may be arranged in the voids 58 between the frames. In this manner, a panel having a single or multiple layers of frames may be formed.

FIGS. 27-30 illustrate another embodiment of the invention where frames F (or sub-frames), that are solid in configuration, are arranged to form a web structure in the same manner as the embodiment shown in FIGS. 16-25. In the embodiment shown in FIGS. 27-30 and FIG. 16, the equatorial points 20, 22 and 24 of the frame $F_4$ contact the equatorial points of adjacent frames $F_1$, $F_2$, and $F_3$. In addition, a lower point 18 of frame $F_1$ contacts the upper point 16 of a frame $F_5$ two layers below, and the equatorial points thereof contact the upper points of the frames directly below. This is also a unique feature of the invention in that a frame in one layer contacts the frames in two directly lower (or upper) successive layers. In FIG. 16, for example, the top layer includes sub-frame $F_4$, the middle layer includes sub-frames $F_1$, $F_2$, $F_3$, and the bottom layer includes sub-frame $F_5$. The lower point 18 of the sub-frame $F_4$ contacts the upper point of sub-frame $F_5$, and the equatorial points of sub-frame $F_4$ contact the upper points of sub-frames $F_1$, $F_2$, $F_3$ in the middle layer. Similarly, each sub-frame just touches the other four sub-frames. This relationship is also present in the embodiment shown in FIGS. 28-30. In the case of diamond, an upper (or lower) tetrahedron contacts the tetrahedra in only one directly preceding lower (or upper) layer (see FIGS. 8 and 10C).

Figure 31:
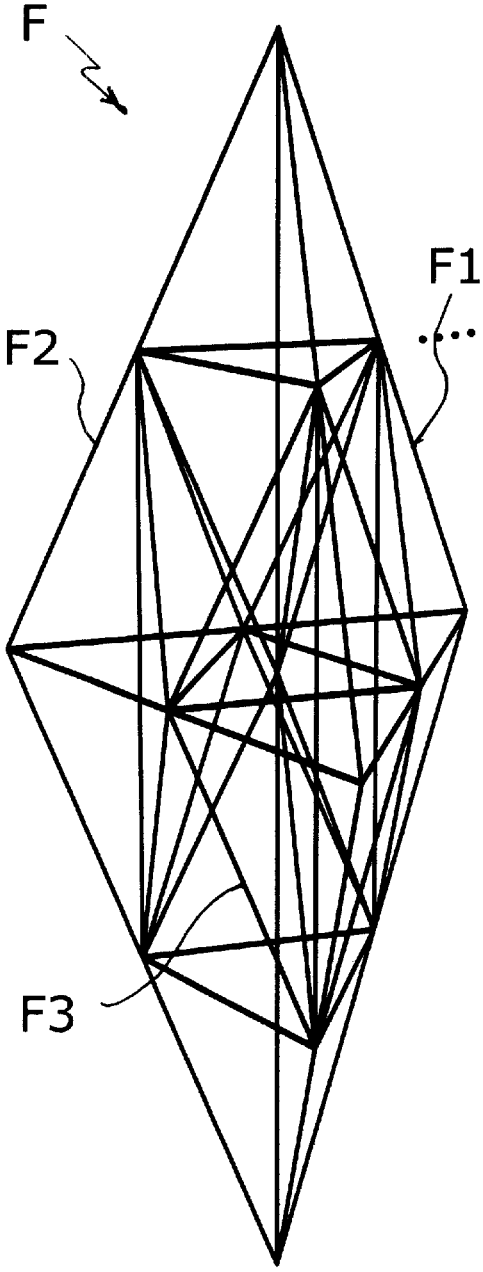
FIG. 31 illustrates a wafer web structure forming a part of a level-1 4-web structure.
Figure 32:
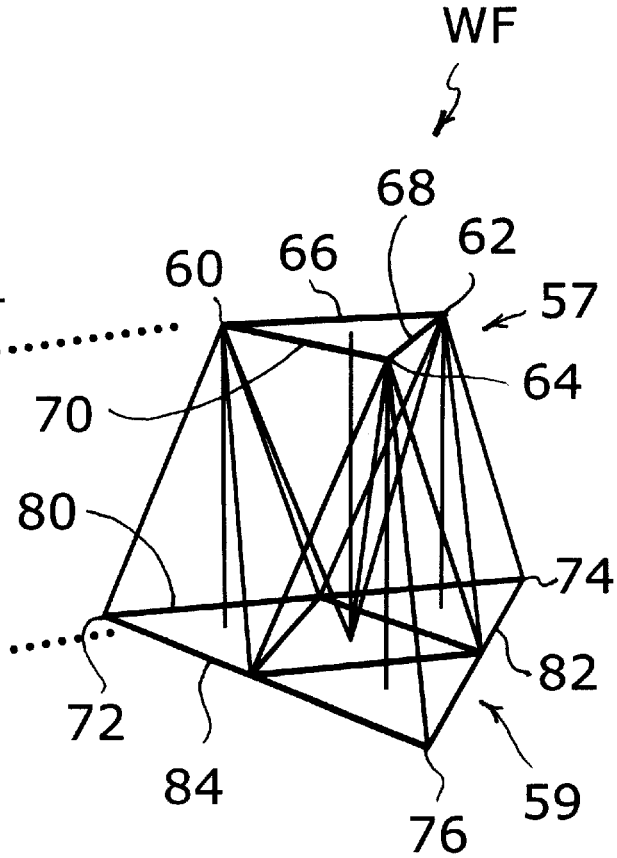
FIG. 32 illustrates a wafer web structure.

FIGS. 31-32 illustrate yet another embodiment of the present invention where a web structure in the form of a wafer WF may be formed. As best illustrated in FIG. 32, the level-1 wafer WF represents a portion of the frame F. In particular, the wafer WF includes the upper halves of sub-frames $F_1$, $F_2$ and $F_3$ shown in FIGS. 14 and 31 and has an apex portion 57 and a base portion 59.

As illustrated in FIG. 32, the upper points or apices 60, 62 and 64 of the wafer WF may be joined by frame segments 66, 68 and 70. Alternatively, the points 60, 62 and 64 may be joined by a generally planar surface (not shown). In either instance, the three upper points 60, 62 and 64 are joined in a generally triangular configuration. In the same manner, equatorial points 72, 74 and 76 may be joined in a generally triangular fashion by frame segments 78, 80 and 82, or be joined by a generally planar surface (not shown).

Figure 33:
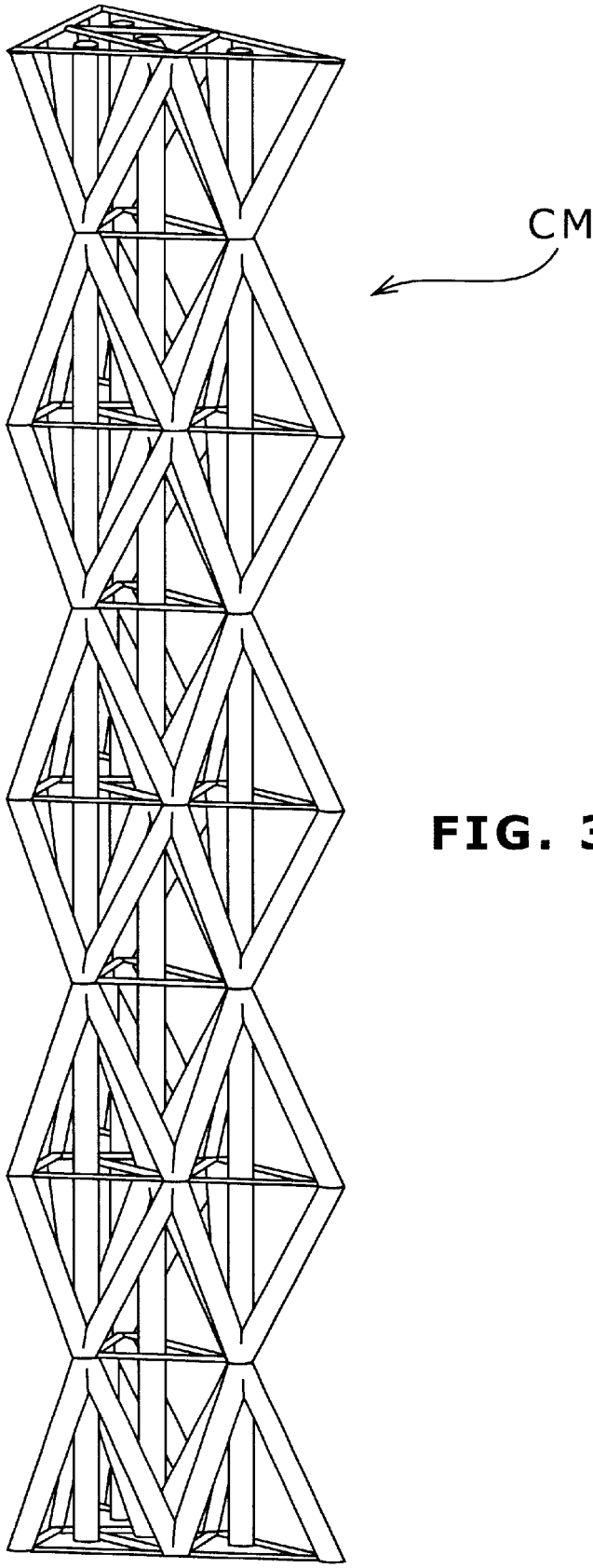
FIG. 33 illustrates a column formed by joining multiple wafers shown in FIG. 32.

As illustrated in FIG. 33, a column CM (or beam) may be formed by arranging the wafers WF by joining the apex portions 57 alternating with joining the bases 59 thereof. It is noted that it is within the scope of this invention to provide different arrangements by utilizing the wafers WF. For example, a column or beam including a plurality of wafer columns or beams may be created, or the stacking sequence of apices/bases may be varied.

The following illustrates various constructions and testing of computer models of fractal-based columns and beams made in accordance with the present invention.

EXPERIMENT 1

Modeling 4-web Columns

Figure 35:
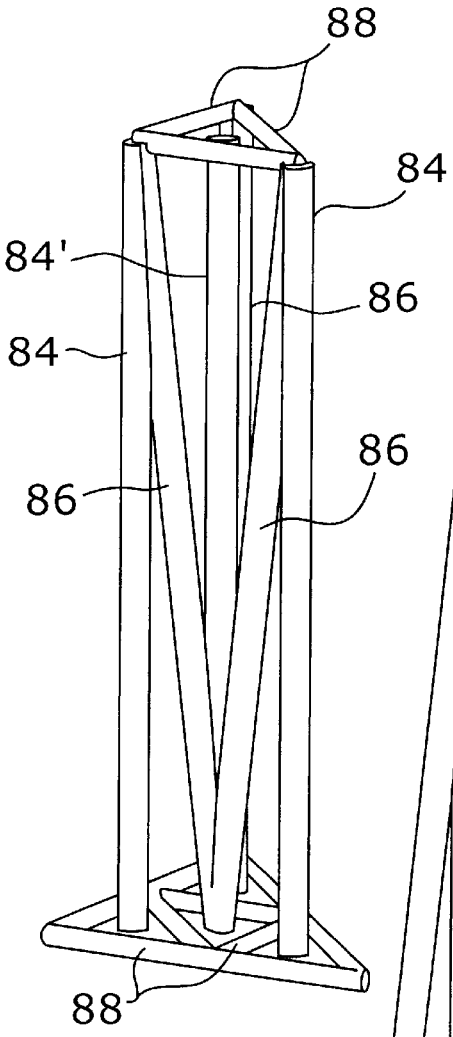
FIGS. 35 and 36 illustrate wafer components that are joined to form the level-1 4-web wafer shown in FIG. 34.
Figure 34:
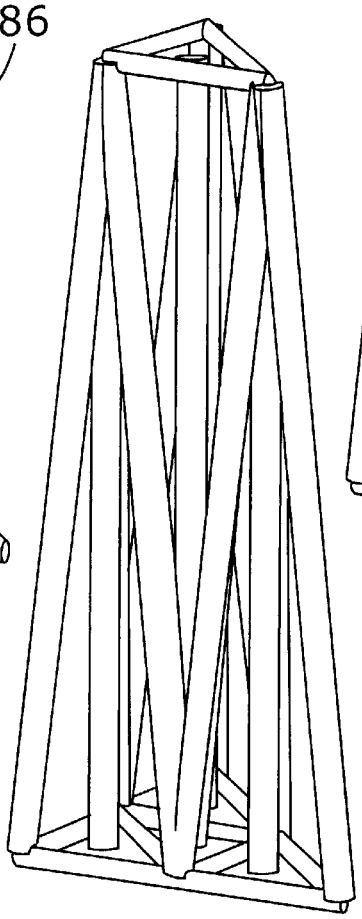
FIG. 34 illustrates a level-1 4-web wafer made by using tubes or solid rods.
Figure 36:
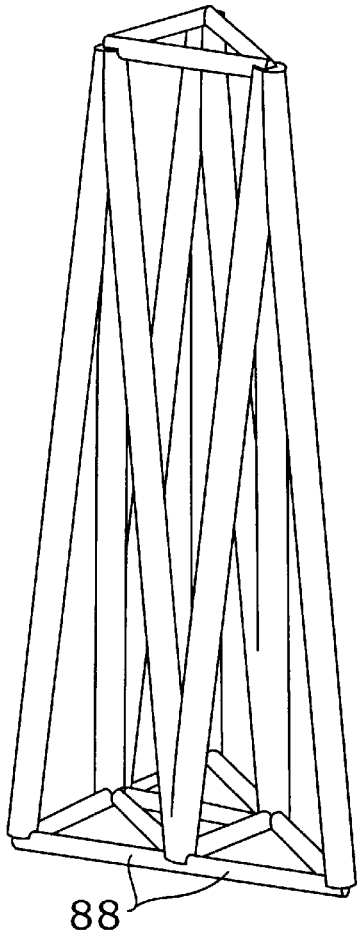
Figure 37:
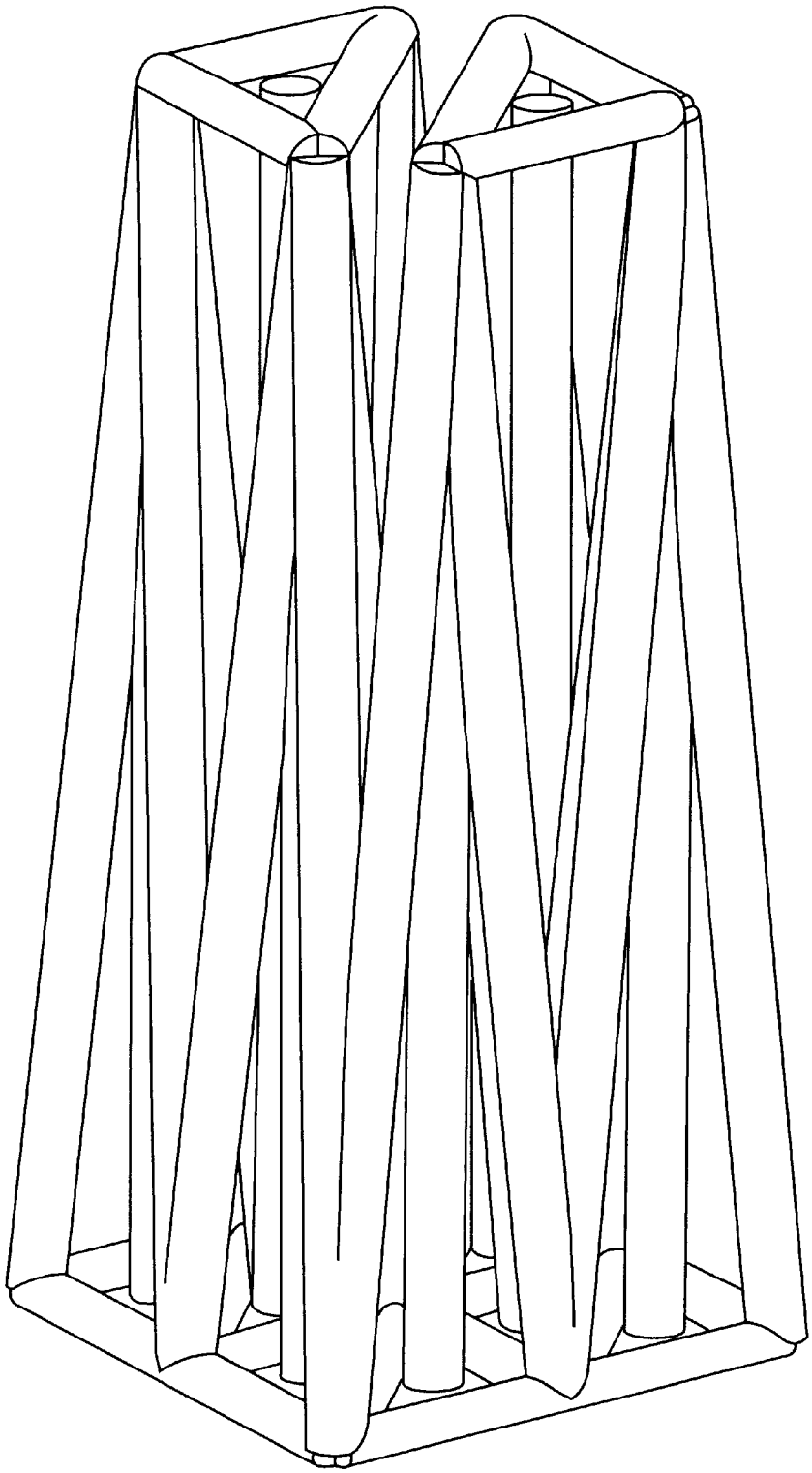
FIG. 37 illustrates a double wafer formed by joining face-to-face two wafers shown in FIG. 34.

Level-0, level-1, and level-2 wafers WF (the basic building blocks) were generated via the process of specifying nodes and edges. Nodes are points in 3-space. Each such point represents the center of a joint where two or more tubes and/or solid rods would be welded together. Edges were provided as pairs of nodes. Each edge represents either a tube or solid rod. The tubes/rods are of three distinct kinds, namely, horizontal, slant, and vertical. FIG. 34 shows a level-1 4-web wafer, and FIGS. 35-36 show all of the tubes/rods that comprise a level-1 4-web wafer. In other words, the wafer components shown in FIGS. 35-36 are joined to form the wafer shown in FIG. 34. In particular, wafer component shown in FIG. 35 includes three vertical edges (or segments) 84. Three slant edges 86 stem from the bottom of the middle segment 84'. The remaining edges 88 form horizontal edges. The wafer component shown in FIG. 36 includes horizontal edges 88 and nine slant edges 86. The wafer (FIG. 34) formed by joining components shown in FIGS. 35-36, therefore, includes twelve slant edges 86 and four vertical edges 84'. FIG. 37 shows a double wafer made by joining two level-1 wafers (FIG. 34) face-to-face.

Figure 38:
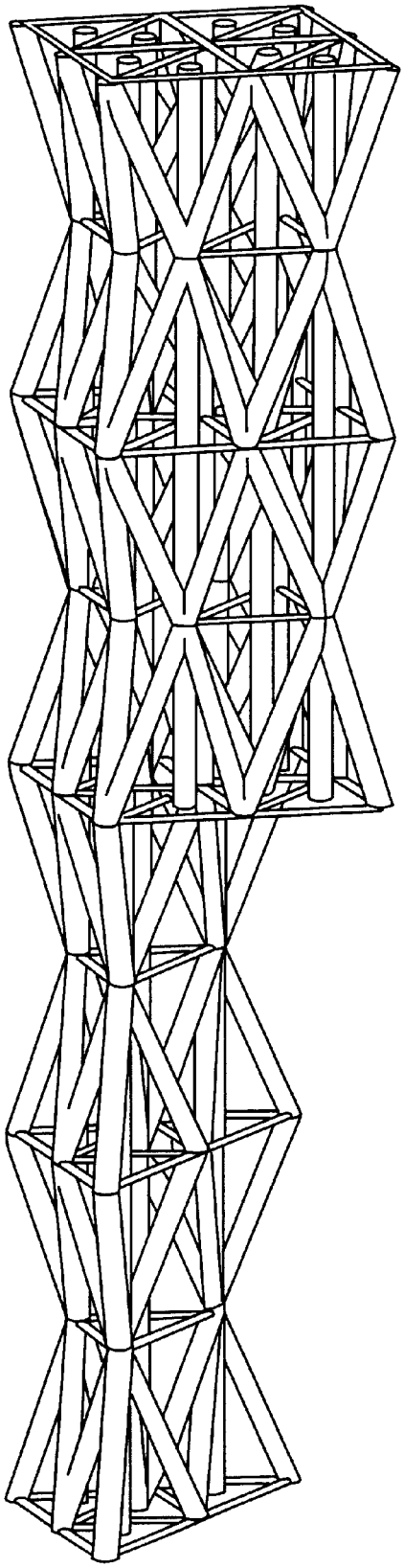
FIG. 38 illustrates a double-wafer column formed by joining a mirror-image of a single wafer column shown in FIG. 33.

The test columns were double-wafer columns. They were constructed in two stages: First, a single-wafer column (FIG. 33) was obtained by stacking wafers. If the wafer was 12" high, then eight wafers provided an 8' column. If the wafer was 6" high, then 16 of those wafers provided an 8' column, etc. Second, a double-wafer column was obtained by joining a mirror image of a single-wafer column to itself (FIG. 38).

Several level-1 double-wafer columns (also called 4-web columns) were computer modeled and tested. The software utilized was MECHANICA Version 21. Its library of beam finite elements contains dialog boxes that allow for specification of the cross-sectional dimensions of individual members (the slants, verticals, and horizontals).

EXPERIMENT 2

Adopting and Understanding Standards

The adopted standards for all columns were (1) a cross-section that would nominally fit into a 3.5-inch by 3.5-inch square; and (2) a height of 8 feet. The goal was to compare various 4-web columns to standard 8-foot sections of A36 structural steel pipe whose outside diameter (OD) was 3.5 inches. Except for Experiment 3 (below), where it was assumed that one end was fixed and one end was free, the tests were restricted to the case where both ends of each column were fixed.

The standard 3.5-inch OD pipes, as well as the 4-web columns, can fail for one of two reasons—they can bend (buckle) or the A36 steel can fail (A36 steel will support up to 36,000 lbs per square inch.) The load C at which an A36 steel pipe will fail due to steel failure is C=A*36000 where A is the cross-sectional area (inches squared) of the pipe. The load B at which a pipe will buckle was calculated via the compressive strength equations [Reference No. 1, page 2–22] and [Reference No. 2, page 28]. A study of various pipes with OD=3.5 inches was conducted.

Understanding Pipes

To understand the pipes, we held the outside diameter at 3.5 inches and varied the inside diameter in steps of 0.05 inches. That is, we considered pipes whose inside diameters were 3.45, 3.40, 3.35, 3.30, 3.25, . . . , 2.85 inches. For each such pipe, we calculated the buckling load B via the compressive strength equations, except that we used phi=1, instead of phi=0.85. Then, as indicated in the previous paragraph, we calculated the load C that would cause the pipe to fail because of compression of the steel, which is independent of the buckling.

Figure 39:
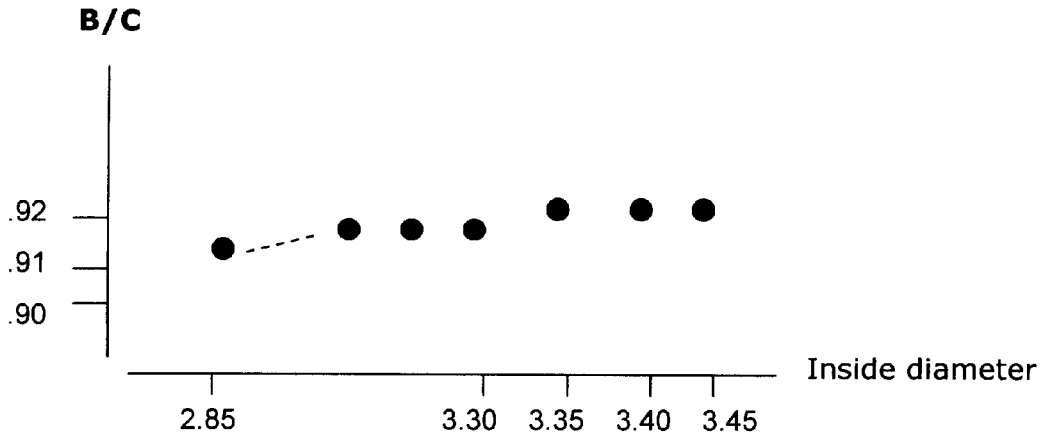
FIGS. 39-40 are graphical illustrations showing the relationships between the inside diameter and buckling/compression loads on pipes.

For example, for a 3.45 inch ID, we find B=9066 lbs and C=9825 lbs; and for a 3.40 inch ID, B=17,982 lbs and C=19,509 lbs. So for both of these IDs, B/C=0.92. We repeated similar calculations for each of the inside diameters mentioned above, obtaining the graph (FIG. 39).

As indicated, the buckling loads (the B's) smoothly decreased to approximately 91% of the corresponding (fail-under-compression) loads (the C's).

Moreover, the weights of these columns are their cross-sectional areas (square inches) times 96 (inches) times (weight of steel/cubic inch). So any column whose cross-sectional area is essentially uniform would be stronger than a similar-weight pipe whose fail-under-compression load was C only if it had buckling load more than 91% of C.

The best that we could do is where B=C, i.e., where B/C=1.00. In such a case the column would fail by buckling at the same time that the steel failed under compression.

Thus, under the same weight constraint, we estimate that any column could only be about 10% stronger than its pipe counterpart. The same weight as a 3.5-inch OD pipe allows for only about a 10% improvement (1.0989*0.91 is approximately 1).

The data in Table 2 (below) show, however, that both the 3- and the 6-inch wafer columns have a buckling load B that was more than twice the corresponding buckling load for a pipe of the same weight. Some members of these 4-web columns may, however, experience failure of their steel at a load L<C where C is the steel-failure load of a comparable pipe. We only tested one 4-web column for steel failure. And indeed, in that lone case, L<C.

A 4-web column is comprised of many relatively small members. The Von Mises plots (a measure of stress on the members of the 4-web column) showed that many of these small members experience relatively small stresses, while others experience quite large stresses. In short, even though we now have a 4-web column with buckling load B>C, we do not yet know how to optimally distribute the steel among the individual members so that we can maximize the (steel-failure) load L to the point where L=C.

We concluded that any future study should include an optimization, i.e., how to redistribute the steel among the members of a 4-web column so that those members that experience the most stress have the most steel.

Larger Pipes (16-foot 6-inch pipes), More Room to Increase Strength!

While we did not model 4-web columns that would compare with these larger pipes, we did study these larger pipes to see if the ratio B/C might be smaller, and found that it was.

Figure 40:
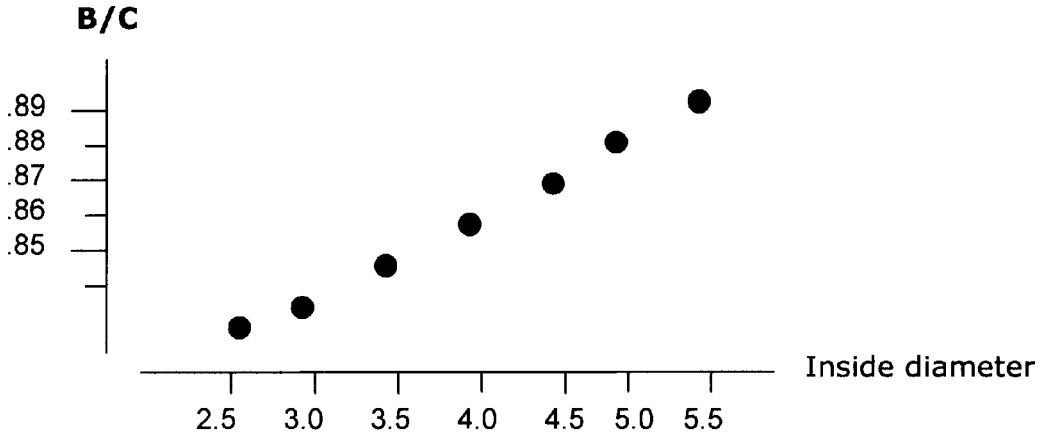

For example, fixing the outside diameter at 6 inches, we calculated B/C for inside diameter of 5.5, 5.0, 4.5, 4.0, 3.5, 3.0, and 2.5 inches. The results are shown in FIG. 40, the lowest ratio being about 83%, which occurs in the strongest pipe that has 2.5 inch inside diameter: For 2.5 ID, we have B=699,979 lbs and C=841,161 lbs. The buckling load for the 3.0 ID is 642,448, for 3.5 ID it is 571,721 etc., showing that as we move from left-to-right the columns are weaker.

These results lead to the following observation: If the buckling loads of comparable 4-web columns also double those of these larger pipes, then the comparable 4-web columns could be up to 20% (1.2048*0.83 is approximately 1) stronger than their pipe counterparts. To test the feasibility of such designs, however, it is again implicit that we would also need an optimization (of steel distribution) study for these larger 6"×6"×16' 4-web columns.

EXPERIMENT 3

The First Computer Results

We started with several level-1 12-inch wafer columns whose members were solid rods. The assumptions underlying the first tests where that the top end of these columns where free, in all other tests the assumption was that we had both ends fixed, allowing movement only in the vertical direction.

Figure 41:
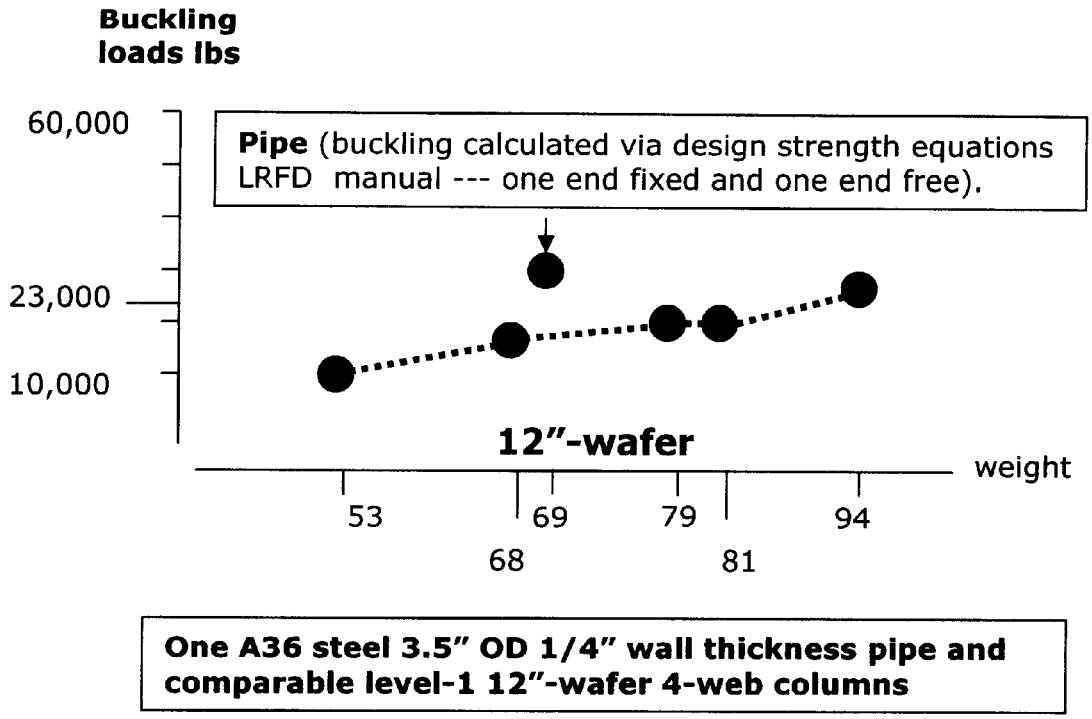
FIG. 41 is a graphical illustration showing buckling loads on 4-web columns made of solid rods.

The 12-inch level-1 wafer columns whose buckling data appear in FIG. 41 had members whose specifications are listed below in Table 1 (note that each member of the 4-web column was a solid rod).

TABLE 1

| PIPE | | | |
|---|---|---|---|
| OD | wall thickness | weight | buckling load |
| 3.5" | .25" | 69.3 lbs | 23,083 LRFD |
| Level-1 12-inch wafer columns | | | |
| Slant/Vertical/Horizontal | | weight | buckling load |
| .2 D/.4 D/.2 D | | 53 lbs | 10,230 |
| .2 D/.5 D/.2 D | | 69 lbs | 12,729 |
| .3 D/.4 D/.2 D | | 79 lbs | 17,050 |
| .3 D/.4 D/.3 D | | 81 lbs | 17,269 |

Note:
All buckling loads on 4-web columns are calculated via Mechanica.

EXPERIMENT 4

Figure 42:
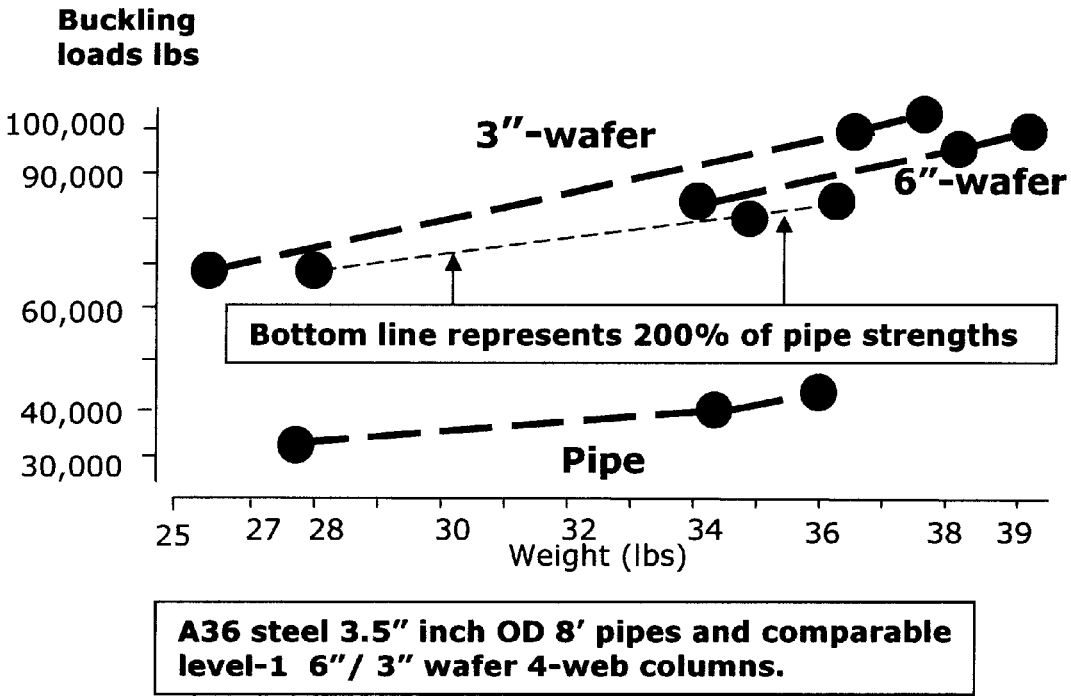
FIG. 42 is a graphical illustration showing buckling loads on 4-web columns made of tubes.

Standard design theory suggests that a decrease in the height of the wafers and a change from solid rods to tubes (on the slants and verticals) would increase resistance to buckling. Such changes require a slight increase in weight (the increase is mainly due to an increase in the number of horizontals). This attempt at optimization provided dramatically positive results. FIG. 42 shows that the buckling loads of the 6" and 3" wafer columns were more than 200% of the buckling loads of their pipe counterparts:

The members (mostly tubes) of the columns referenced in FIG. 42, were as provided below in Table 2:

TABLE 2

| PIPE | | | |
|---|---|---|---|
| OD | wall thickness | weight | buckling load |
| 3.5 | .095 | 27.64 | 33,900 |
| 3.5 | .120 | 34.7 | 42,000 |
| 3.5 | .125 | 36.048 | 44,000 |
| Slant/Vertical | Horizontal | weight | buckling load |
| Level-1 6-inch wafer columns | | | |
| .55 OD/.505 ID | .1 D | 33.96 | 84,400 |
| .55 OD/.500 ID | .1 D | 37.427 | 93,117 |
| .55 OD/.4975 ID | .1 D | 39.157 | 97,423 |
| Level-1 3-inch wafer columns | | | |
| .55 OD/.521 ID | .1 D | 24.967 | 68,205 |
| .55 OD/.506 ID | .1 D | 36.048 | 98,537 |
| .55 OD/.505 ID | .1 D | 36.78 | 100,047 |

EXPERIMENT 5

Bulking Sensitivity to Height of Water

The following Table 3 compares two level-1 double-wafer 8-foot columns whose members are solid rods. Note that as we go from the 6"- to the 3"-wafer columns that the increase in steel is only about 22% (7+pounds); but that the buckling load increases by a factor of more than 332%! ("VM" is Von Mises in lbs/(sq inch), which is a measure of the stress.)

for these 4-web columns exceed the corresponding pipe (LRFD) design loads. The pipe LRFD loads merely serve as a reference from which we can observe the increase in buckling loads of 4-webs relative to change in wafer height. Indeed, we did not calculate design loads for 4-web columns. Such results point to the need for determining the optimum distribution of the steel. (Steel would be added to those members receiving maximum stress, and removed from those with minimum stress.)

Upon reconsideration, we might have picked a size of pipe (our standard) that left very little room for improvement. That is, if we work under the same weight constraint, the standard only left room for about 10% improvement. Nevertheless, we demonstrated that these 4-web column designs allow for dramatically increasing buckling loads by reducing wafer height. The 12"-wafer columns had buckling loads that were less than the corresponding (same weight/profile) pipe LRFD design loads. The 6"-wafer column buckling loads exceeded pipe LRFD design loads by more that a factor of 200%; and the 3"-wafer columns exceeded their (similar weight) 6"-wafer counterparts. And since these columns have many members, an optimization might show that 4-web columns can yield the optimum for a given amount of steel. Indeed, the right redistribution of the steel might very well improve the performance beyond anything now available.

Even at our current stage of understanding, i.e., where only two estimates at optimization were made, there is one glaring positive. These high buckling numbers imply that (at the very least) applications may appear in the form of hybrid structures.

Beams

We also initiated a study of 4-web beams. A reasonable approach would parallel our study of columns, i.e., it would

TABLE 3

| WAFER | WEIGHT | BUCKLING LOAD | SLANT/VERTICAL/HORIZONTAL | SLANT VM | VERTICAL VM | HORIZONTAL VM |
|---|---|---|---|---|---|---|
| 6-INCHES | 32.14 | 17,914 LBS | .2 .2 .2 | 10888 | 10888 | 3629 |
| 3-INCHES | 39.28 | 59,566 LBS | .2 .2 .2 | 10890 | 12360 | 5494 |

EXPERIMENT 6

Level-2 Double Wafers

Figure 44:
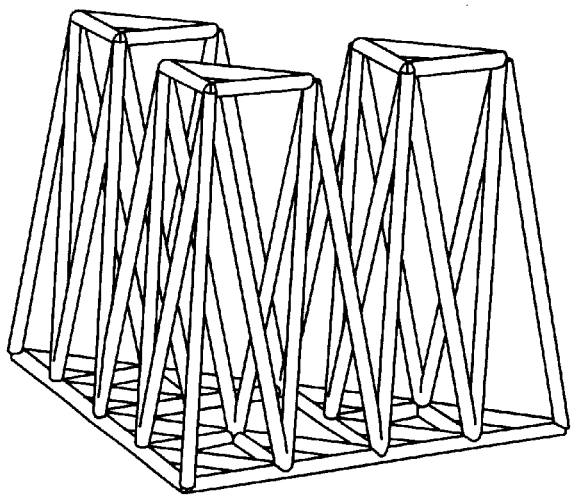
FIGS. 44-45 illustrate wafer components used to form the wafer shown in FIG. 43.
Figure 43:
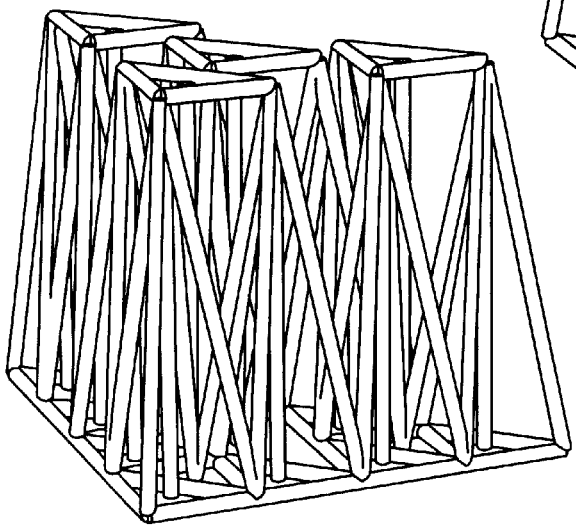
FIG. 43 illustrates a level-2 single-wafer.
Figure 45:
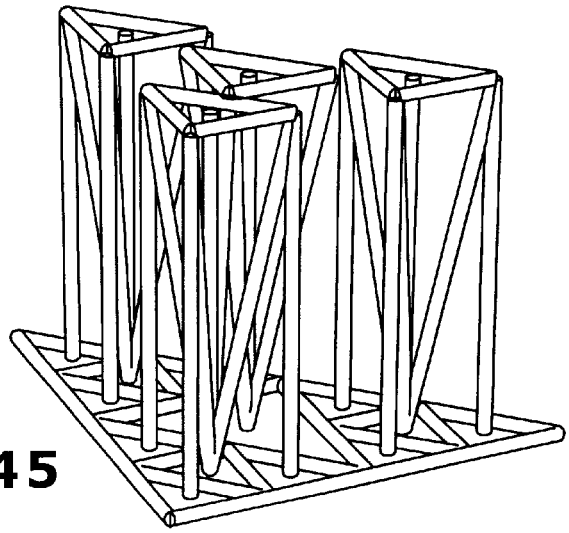
Figure 46:
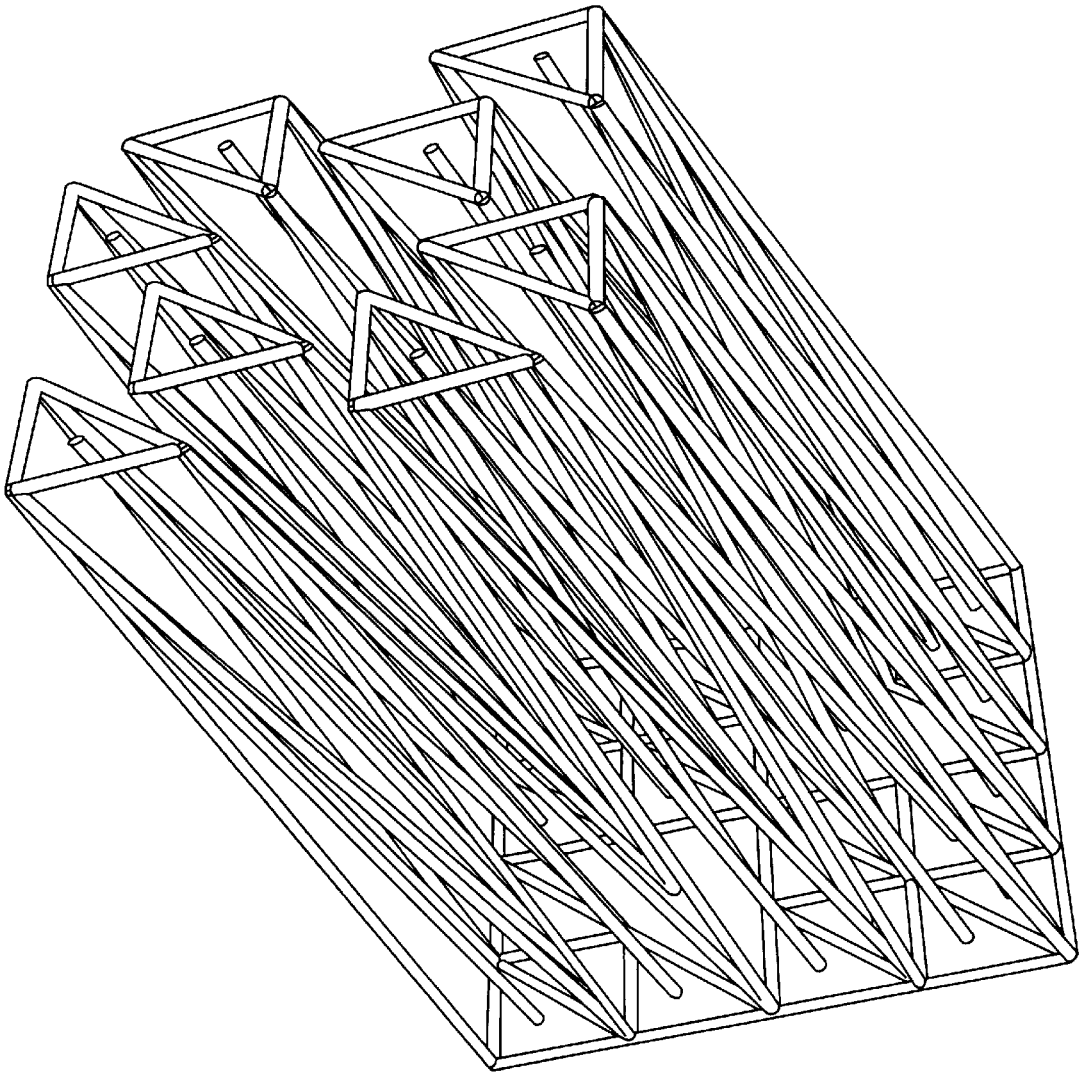
FIG. 46 illustrates a level-2 double-wafer.

Even though a study of level-2 wafer columns was not undertaken, a computer model was encoded. A level-2 single-wafer is shown in FIG. 43. FIGS. 44-45 show the slants, verticals, and horizontals. A level-2 double-wafer is shown in FIG. 46.

Summary of the Column Study

In general, columns of 3" wafers were stronger than those of 6" wafers, just as those of 6" wafers were stronger than those of 12" wafers. The cross-sections of the columns fall within a 3.5" by 3.5" square. The standard height was 8 feet. Our study was limited to level-1 double-wafer columns. The theory suggests that in addition to making stronger and stronger columns using ever-shorter wafers, we can also use higher and higher levels of wafers to increase the strength. We did not test the higher-level designs, although we did model a level-2 wafer.

The study of level-1 double-wafer columns demonstrates how to design columns with exceptionally high buckling loads. There was one test case, however, where a relatively low column load induced steel failure in some members. It should not be inferred from these data that the design loads include the following phases: (1) design; (2) generate computer models; (3) find/define standards for comparisons; (4) make comparisons; (5) try to optimize the design by using the knowledge gained in phase (4).

Figure 47:
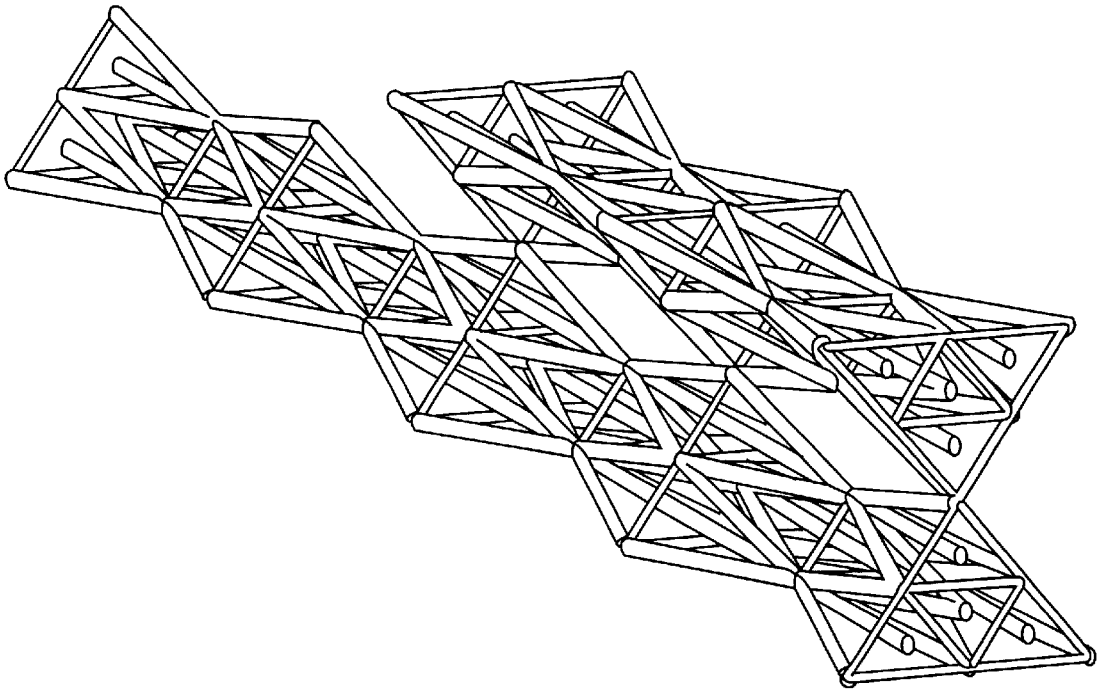
FIG. 47 illustrates a beam formed of single-wafer columns shown in FIG. 33.

In phases 1 and 2, we started with a beam built from existing models, namely, a beam built from the single-wafer columns (described in Experiment 1 above). The concept, called an "X-beam," involved two such columns (FIG. 47). They would be joined together via certain node-to-node identifications.

Then came phase 3, looking for standards. Hindsight shows that the beam case is innately more complex than the column case. In a simple beam test case, it became clear that we needed to think carefully about how we apply loads to such a beam. The X-beam is basically a truss whose cross-section varies but nominally fits inside of a 5" by 5" square. These beams/trusses have relatively small members that are strong only as two-force members (compression/tension). To test such a structure, we added about 20+ lbs of steel. Then, looking for a comparable I-beam of the same weight, we estimated at a W6×20. But the 6.2" (=depth) by 6.018" (flange-width) rectangle that nominally contains the cross-section of a W6×20 I-beam has an area that is about 50% larger than any cross-section of our X-beam. To get a better match, we could have scaled up our X-beam, but that would have taken us back to the design phase, i.e., phase 1.

Summary of Beam Study

In the case of cantilever beams, we had originally planned on encoding a skewed 4-web design. Such a design differs from those described above in that the verticals are not perpendicular to the horizontals (as was the case in each of the designs discussed above). That these kinds of 4-webs exist is established in [Reference 3].

Figure 48:
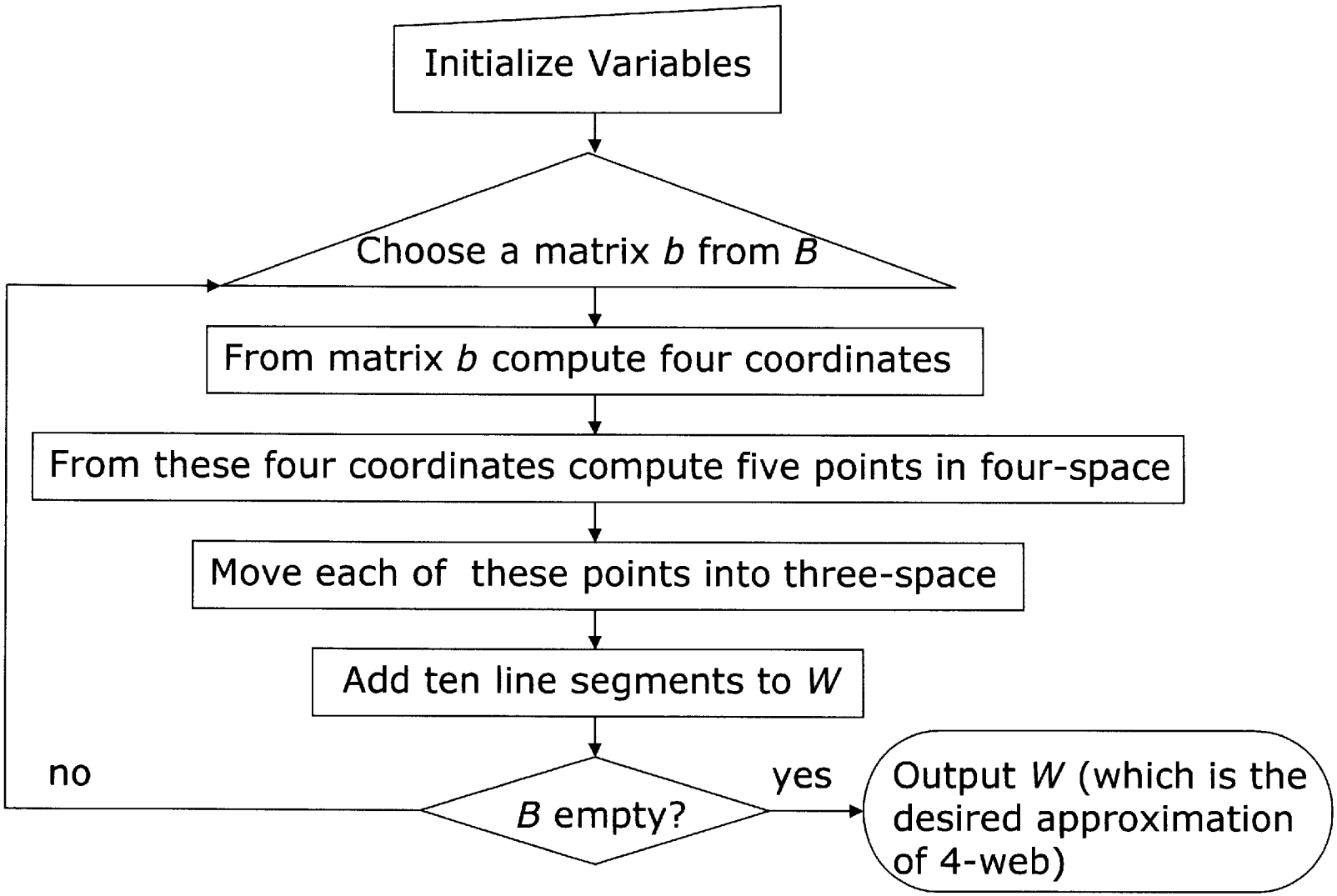
FIG. 48 illustrates a block diagram of the algorithm of the invention.

The following is the 4-web construction algorithm, as illustrated in block diagram shown in FIG. 48.

4-Web Construction Algorithm

1. Initialize the variables:
   n←a user supplied nonnegative integer
   M←a user supplied 3×3 nonsingular matrix with real entries
   C←a user supplied 3×1 matrix with real entries
   H←the matrix H defined in the paper The generalization of Sierpinski's Triangle that lives in 4-space $$H = \begin{bmatrix} 1 & 0 & 0 & 2/3 \\ 0 & 1 & 0 & 2/3 \\ 0 & 0 & 1 & 2/3 \end{bmatrix}$$

2. Choose a matrix $[b_{ij}]$ from β:

$$[b_{ij}] \leftarrow \text{some matrix in } \beta$$

$$\beta \leftarrow \beta - \{[b_{ij}]\}$$

3. From the matrix $[b_{ij}]$ compute four coordinates:

$$x_1 \leftarrow \sum_{j=1}^{n} \frac{b_{1,j}}{2^j}$$

$$x_2 \leftarrow \sum_{j=1}^{n} \frac{b_{2,j}}{2^j}$$

$$x_3 \leftarrow \sum_{j=1}^{n} \frac{b_{3,j}}{2^j}$$

$$x_4 \leftarrow \sum_{j=1}^{n} \frac{b_{4,j}}{2^j}$$

4. From these four coordinates compute five points in four-space:

$$P_1 \leftarrow \begin{bmatrix} x_1 \\ x_2 \\ x_3 \\ x_4 \end{bmatrix}$$

$$P_2 \leftarrow \begin{bmatrix} x_1 + \frac{1}{2^n} \\ x_2 \\ x_3 \\ x_4 \end{bmatrix}$$

$$P_3 \leftarrow \begin{bmatrix} x_1 \\ x_2 + \frac{1}{2^n} \\ x_3 \\ x_4 \end{bmatrix}$$

-continued $$P_4 \leftarrow \begin{bmatrix} x_1 \\ x_2 \\ x_3 + \frac{1}{2^n} \\ x_4 \end{bmatrix}$$

$$P_5 \leftarrow \begin{bmatrix} x_1 \\ x_2 \\ x_3 \\ x_4 + \frac{1}{2^n} \end{bmatrix}$$

5. Move each of these points into three-space:

$$Q_1 \leftarrow MPH_1 + C$$

$$Q_2 \leftarrow MPH_2 + C$$

$$Q_3 \leftarrow MPH_3 + C$$

$$Q_4 \leftarrow MPH_4 + C$$

$$Q_5 \leftarrow MPH_5 + C$$

6. Add ten line segments to W:

$$W \leftarrow W \cup \{\overline{Q_1Q_2}, \overline{Q_1Q_3}, \overline{Q_1Q_4}, \overline{Q_1Q_5}, \overline{Q_2Q_3}, \overline{Q_2Q_4}, \overline{Q_2Q_5}, \overline{Q_3Q_4}, \overline{Q_3Q_5}, \overline{Q_4Q_5}\}$$

7. If β is not empty then go to step 2
8. Output W (which is the n-th approximation of the 4-web)

While this invention has been described as having preferred sequences, ranges, steps, materials, or designs, it is understood that it includes further modifications, variations, uses and/or adaptations thereof following in general the principle of the invention, and including such departures from the present disclosure as those come within the known or customary practice in the art to which the invention pertains, and as may be applied to the central features hereinbeforesetforth, and fall within the scope of the invention and of the limits of the appended claims.

REFERENCES

The following references, to the extent that they provide exemplary procedural or other details supplementary to those set forth herein, are specifically incorporated herein by reference.

1. Load & Resistance Factor Design (LRFD), American Institute of Steel Construction (AISC) Manual of Steel Construction (Second Edition) Volume 1, 1998.
2. Structural Steel Design, Schaum's Outlines, Abraham J. Rokach, McGraw-Hill, 1991.
3. The generalization of Sierpinski's Triangle that lives in 4-space, J. Perry & S. Lipscomb, accepted for publication (December 2001) in Houston Journal of Mathematics.

What I claim is:

1. A web structure, comprising:

a) a generally hexahedron-shaped frame;

b) said frame comprising a plurality of points oriented in a manner that no more than three points lie in a common plane;

c) each pair of the points being connected by a frame segment;

d) a plane comprising three of said points;

e) one frame segment passing through said plane and including first and second ends; and f) said first and second ends of said one frame segment being generally equidistant from said plane.

2. The web structure of claim 1, wherein:

a) said one frame segment is generally perpendicular or skewed to said plane; and b) said one frame segment passes through the geometric center of said plane.

3. The web structure of claim 1, wherein:

a) the three points in said plane form a triangle.

4. The web structure of claim 1, wherein:

a) said frame comprises five points and ten triangles.

5. The web structure of claim 4, wherein:

a) said first and second ends of said one frame segment are generally coincident with two of the five points.

6. The web structure of claim 5, wherein:

a) said one frame segment comprises a generally straight frame segment.

7. The web structure of claim 6, wherein:

a) said one frame segment forms a triangle with each of the three points in said plane.

8. The web structure of claim 7, wherein:

a) two of the three points in said plane form two triangles with the remaining two points at said first and second ends of said one frame segment.

9. The web structure of claim 1, wherein:

a) the frame segment connecting each pair of the points comprises a generally straight frame segment.

10. A web structure, comprising a plurality of frames of claim 1.

11. The web structure of claim 10, wherein:

a) said frames are disposed in a side-by-side relationship.

12. The web structure of claim 10, wherein:

a) said frames are disposed in a plurality of layers.

13. The web structure of claim 10, wherein:

a) said frames comprise first and second groups;

b) one of said first and second groups is disposed in a side-by-side manner; and c) the other of said first and second groups is disposed in a plurality of layers.

14. The web structure of claim 13, wherein:

a) the layers comprise first, second, and third successive layers; and b) one of said frames in said first layer contacts a frame in each of said second and third layers.

15. A structural element, comprising a plurality of web structures of claim 1.

16. The structural element of claim 15, wherein:

a) the structural element is selected from the group consisting of a panel, a beam, a truss, a pillar, and a lattice.

17. A web structure, comprising:

a) a generally hexahedron-shaped outer member comprising first, second, third, fourth, and fifth vertices;

b) a plane comprising said third, fourth, and fifth vertices;

c) said first and second vertices being spaced away from said plane;

d) a plurality of generally hexahedron-shaped inner members disposed in said outer member; and e) said inner members comprising the same general configuration as said outer member.

18. The web structure of claim 17, wherein:

a) a first and a second of said inner members are disposed in said outer member in a manner that the second vertex of said first inner member contacts the first vertex of said second inner member.

19. The web structure of claim 18, wherein:

a) a third of said inner members is disposed in said outer member generally between said first and second inner members; and b) first and second vertices of said third inner member contact one of the third, fourth and fifth vertices of respective first and second inner members.

20. The web structure of claim 17, wherein:

a) three of said inner members are disposed in said outer member about said plane; and c) one of said inner members is disposed on each side of said plane.

21. The web structure of claim 20, wherein:

a) said outer member comprises a zero level;

b) said inner members comprise a first level;

c) a third level disposed in said first level; and d) said third level comprises hexahedron-shaped members comprising the same general configuration as said outer member.

22. The web structure of claim 21, further comprising:

a) an infinite number of levels 'n', wherein 'n' comprises a nonnegative integer; and b) a higher number level is disposed in a preceding lower number level.

23. A structural element, comprising the web structure of claim 17.

24. The structural element of claim 23, wherein:

a) the structural element is selected from the group consisting of a panel, a beam, a truss, a pillar, and a lattice.

25. A web structure, comprising:

a) a generally hexahedron-shaped frame;

b) said frame comprising first and second generally trihedron-shaped portions joined at the bases thereof;

c) said first and second portions comprising first and second vertices, respectively;

d) said frame comprising a plane;

e) a frame segment joining said first and second vertices; and f) said frame segment passing through said plane.

26. A method of forming a web structure, comprising the steps of:

a) providing a plurality of generally hexahedron-shaped frames;

b) each of the frames, comprising:

i) a plurality of points oriented in a manner that no more than three points lie in a common plane;

ii) each pair of the points being connected by a frame segment;

iii) a plane comprising three of the points;

iv) one frame segment passing through the plane and including first and second ends; and v) the first and second ends of the one frame segment being generally equidistant from the plane;

c) arranging a plurality of the frames in a side-by-side manner that one of the three points in the plane of a frame contacts one of the three points in the plane of an adjacent frame; and d) arranging a plurality of the frames in a manner that one of the first and second ends of the one frame segment of a frame contacts the other of the first and second ends of the one frame segment of an adjacent frame.

27. A method of forming a web structure, comprising the steps of:

a) providing a plurality of generally hexahedron-shaped members;

b) each of the members, comprising:

i) first, second, third, fourth, and fifth vertices;

ii) a plane comprising the third, fourth, and fifth vertices; and iii) the first and second vertices being spaced away from the plane;

c) arranging a plurality of the members in a side-by-side manner that one of the third, fourth, and fifth vertices of a member contacts one of the third, fourth, and fifth vertices of an adjacent member;

d) arranging a plurality of the members in a manner that one of the first and second vertices of a member contacts the other of the first and second vertices of an adjacent member.

* * * * *